United States Patent [19]

Blazey et al.

[11] 4,307,165

[45] Dec. 22, 1981

[54] PLURAL IMAGING COMPONENT MICROCELLULAR ARRAYS, PROCESSES FOR THEIR FABRICATION, AND ELECTROGRAPHIC COMPOSITIONS

[75] Inventors: Richard N. Blazey, Penfield; Peter S. Alexandrovich, Rochester; Domenic Santilli, Webster; Michael W. Mosehauer, Rochester, all of N.Y.

[73] Assignee: Eastman Kodak Company, Rochester, N.Y.

[21] Appl. No.: 193,065

[22] Filed: Oct. 2, 1980

[51] Int. Cl.[3] ..... G03G 5/04; G03G 9/12; G03G 13/22

[52] U.S. Cl. ..... 430/8; 430/31; 430/32; 430/42; 430/44; 430/54; 430/56; 430/62; 430/111; 430/106; 430/114; 430/119; 430/363; 430/365; 430/945; 355/3 P; 355/4; 355/7; 355/10; 355/15; 430/45; 430/46; 430/496

[58] Field of Search ..... 430/46, 8, 31, 32, 44, 430/54, 106, 114, 119, 496

[56] References Cited

U.S. PATENT DOCUMENTS

| | | | |
|---|---|---|---|
| 3,253,913 | 5/1960 | Smith et al. | 430/45 |
| 3,383,209 | 5/1968 | Cassiers et al. | 430/103 |
| 3,425,829 | 2/1969 | Cassiers et al. | 430/118 |
| 3,486,922 | 12/1969 | Cassiers et al. | 430/118 |
| 3,561,358 | 2/1971 | Weigl | 430/49 |

*Primary Examiner*—John D. Welsh
*Attorney, Agent, or Firm*—Carl O. Thomas

[57] ABSTRACT

A planar array of microcells is formed in a support. An electrostatic charge pattern is established on the support differentiating first and second interlaid sets of microcells. An electrographic imaging composition is introduced into the first set of microcells, and a second, differing imaging composition is introduced into the second set of microcells. Multicolor photographic elements, particularly dye image transfer photographic elements, can be prepared.

40 Claims, 10 Drawing Figures

FIG. 1A
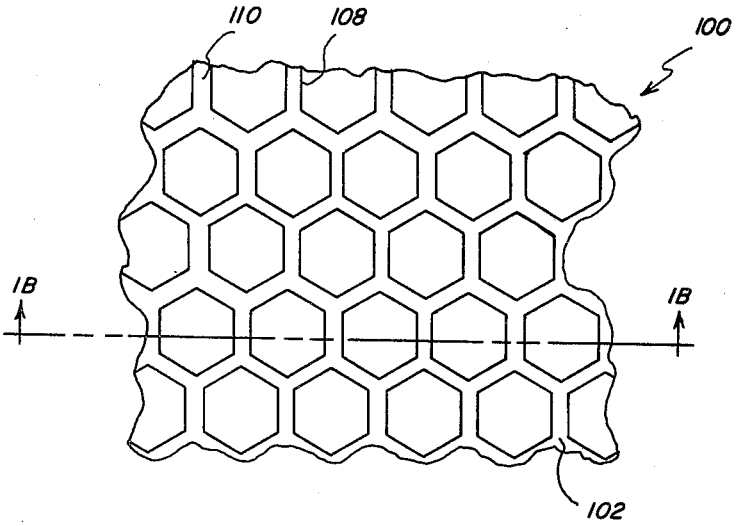
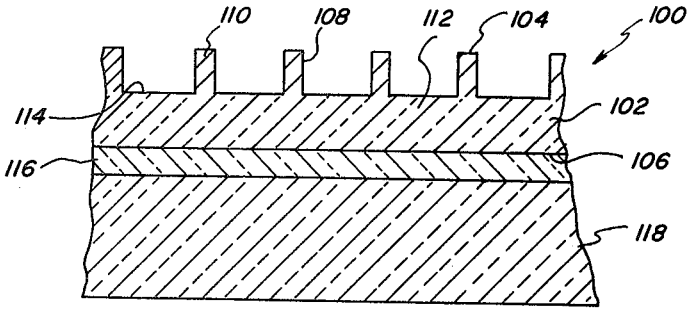
FIG. 1B

FIG. 2A
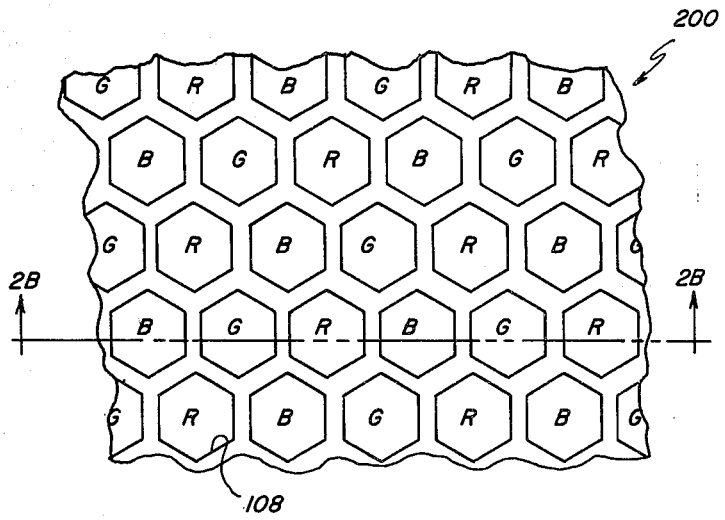
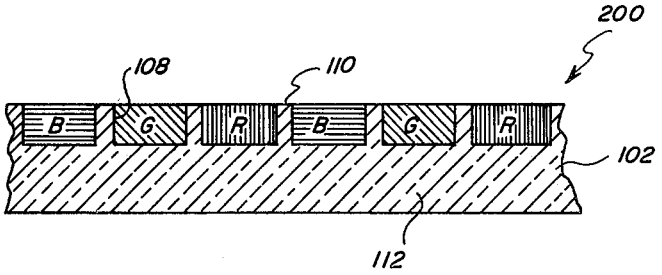
FIG. 2B

PLURAL IMAGING COMPONENT MICROCELLULAR ARRAYS, PROCESSES FOR THEIR FABRICATION, AND ELECTROGRAPHIC COMPOSITIONS

FIELD OF THE INVENTION

This invention is directed to improved microcellular elements containing two or more imaging compositions, particularly multicolor photographic elements and more particularly multicolor image transfer photographic elements. In addition this invention is directed to processes of preparing such elements and to preferred imaging compositions.

BACKGROUND OF THE INVENTION

This invention is an improvement on K. E. Whitmore U.S. Ser. No. 184,714, filed Sept. 8, 1980, commonly assigned, titled IMAGING WITH NONPLANAR SUPPORT ELEMENTS, which is a continuation-in-part of U.S. Ser. No. 008,819, filed Feb. 2, 1979, now abandoned. Whitmore applies to photographic imaging the use of supports containing arrays of microcells (or microvessels) opening toward one major surface. In a variety of different forms the photographic elements and components disclosed by Whitmore contain an array of microcells in which first, second, and, usually, third sets of microcells are interspersed to form an interlaid pattern. In a typical form three separate sets of microcells, each containing a different subtractive primary (i.e., yellow, magenta, or cyan) or additive primary (i.e., blue, green, or red) imaging component, are interlaid. Preferably each microcell of each set is positioned laterally next adjacent at least one microcell of each of the two remaining sets. The microcells are intentionally sized so that they are not readily individually resolved by the human eye, and the interlaid relationship of the microcell sets further aids the eye in fusing the imaging components of the separate sets of microcells into a balanced multicolor image.

In one specifically preferred embodiment disclosed by Whitmore, cyan, magenta, and yellow dyes or dye precursors of alterable mobility are associated with immobile red, green and blue colorants, respectively, each present in one of the first, second, and third sets of microcells, and the microcells are overcoated with a panchromatically sensitized silver halide emulsion layer. By exposing the silver halide emulsion layer through the microcells and then developing, an additive primary multicolor negative image can be formed by the microcellular array and the silver halide emulsion layer while cyan, magenta, and yellow dyes can be transferred to a receiver in an inverse relationship to imagewise exposure to form a subtractive primary positive multicolor image. The foregoing is merely exemplary, many other embodiments being disclosed by Whitmore.

A technique disclosed by Whitmore for differentially filling microcells to form an interlaid pattern calls for first filling the microcells of an array with a sublimable material. The individual microcells forming a first set within the array can then be individually addressed with a laser to sublime the material initially occupying the first set of microcells. The emptied microcells can then be filled by any convenient conventional technique with a first imaging component. The process is repeated acting on a second, interlaid set of microcells and filling the second set of emptied microcells with a second imaging component. The process can be repeated again where a third set of interlaid microcells is to be filled, although individual addressing of microcells is not in this instance required. This approach is suggested by Whitmore to be useful in individually placing triads of additive and/or subtractive primary materials in first, second, and third sets of microcells, respectively.

H. S. A. Gilmour U.S. Ser. No. 192,976, filed Oct. 1, 1980, commonly assigned, titled AN IMPROVEMENT IN THE FABRICATION OF ARRAYS CONTAINING INTERLAID PATTERNS OF MICROCELLS, improves on Whitemore's process of filling interlaid sets of microcells with differing imaging compositions by employing a thermally destructible membrane to close one set of microcells while another set is being filled with or emptied of imaging material. The present invention improves on both Whitmore and Gilmour in that neither sublimable materials nor membranes are required to obtain interlaid sets of microcells containing differing imaging compositions.

Weigl U.S. Pat. No. 3,561,358 employs a photoconductive support having uniformly spaced recessed areas or cells for gravure printing. The recessed support is first electrostatically charged and then selectively discharged by imagewise exposure. The recessed areas retaining electrostatic charge are then selectively filled with toner particles. Thereafter, when a gravure printing ink is spread uniformly across the support, it selectively enters the recessed areas not occluded by the toner particles. To obtain a reversed distribution of printing ink, instead of immediately introducing the printing ink, a resinous liquid is placed in the unoccluded recessed areas not containing toner particles. The resinous liquid is fixed in place and the toner particles removed. The gravure printing ink is introduced into the recessed areas from which the toner is removed.

Smith et al U.S. Pat. No. 3,253,913 teaches the formation of multicolor images by employing three electrographic developers, each containing a separate subtractive primary dye-forming coupler. By using color separation masters and exposing a planar photoconductive support three times through separate masters followed each time by the use of a different developer, three superimposed subtractive primary images can be produced on the photoconductive support which, when viewed together, form a multicolor image.

Cassiers et al U.S. Pat. Nos. 3,383,209, 3,425,829, and 3,486,922 disclose an imaging process in which an electrostatic image pattern is formed on a photoconductive layer and an aqueous composition is uniformly spread over the layer. Selective wetting occurs in charged areas of the layer. To influence wetting characteristics, the photoconductive support can be roughened—e.g., by applying a regular or irregular screen pattern. Liquid permeability of the photoconductive layer, as through random micropores, can be tolerated. Both preformed colorants and colorant precursors, such as couplers, can be present in the aqueous composition.

SUMMARY OF THE INVENTION

In one aspect, this invention is directed to an element comprising a support means having first and second major surfaces including a portion defining microcells opening toward the first major surface to form a planar array. Two or more differing imaging compositions are each located in a separate interlaid set of the microcells.

The support position is photoconductive and at least one of the imaging compositions is electrographic.

In another aspect, this invention is directed to a process comprising forming in a support having first and second major surfaces a planar array of microcells opening toward the first major surface. A first imaging composition is selectively introduced into a first set of microcells, and a second, differing imaging composition is selectively introduced into a second set of microcells forming an interlaid pattern with the first set of microcells. An electrostatic charge pattern is established on the support differentiating the first and second sets of microcells and thereby permitting selectively introducing an electrographic first imaging composition into the first set of microcells.

In an additional aspect, this invention is directed to an electrographic imaging composition comprising a colorant portion and from 0.1 to 10 parts by weight per part of the colorant portion of a resinous portion. The colorant portion is comprised on one of more immobile colorants collectively capable of producing an additive primary color and a subtractive primay dye or dye precursor capable of shifting between a mobile and an immobile form as a function of silver halide development. The resinous portion is capable of forming a particulate dispersion with the colorant portion in a liquid carrier vehicle having a dielectric constant of less than 3.0 and a resistivity of at least $10^{10}$ ohm-cm. At least one of the colorant and resinous portions is chosen to impart an electrostatic charge of a selected polarity to the particulate dispersion in the liquid carrier.

The invention can be better appreciated by reference to the following detailed description of preferred embodiments in conjunction with the drawings, in which FIG. 1A is a plan view of a support according to the present invention;

FIG. 1B is a section taken along section line 1B—1B in FIG. 1A;

FIG. 2A is a plan view of a multicolor filter element;

FIG. 2B is a section taken along section line 2B—2B in FIG. 2A;

Figure 4:
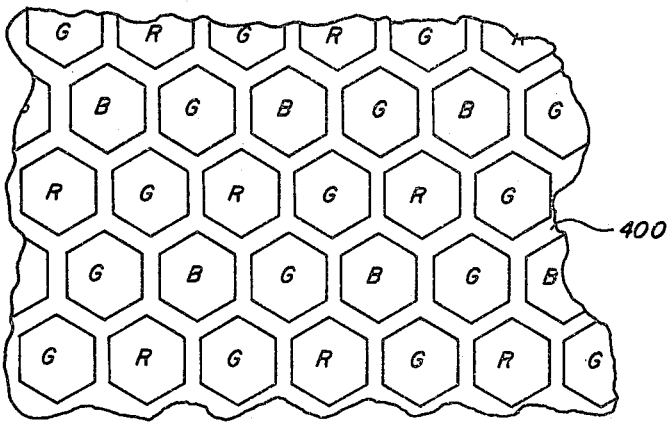

FIGS. 3A, 3B, 3C, and 3D are sectional views illustrating successive preparation stages;

FIG. 4 is a plan view of an alternative multicolor filter element; and

Figure 5:
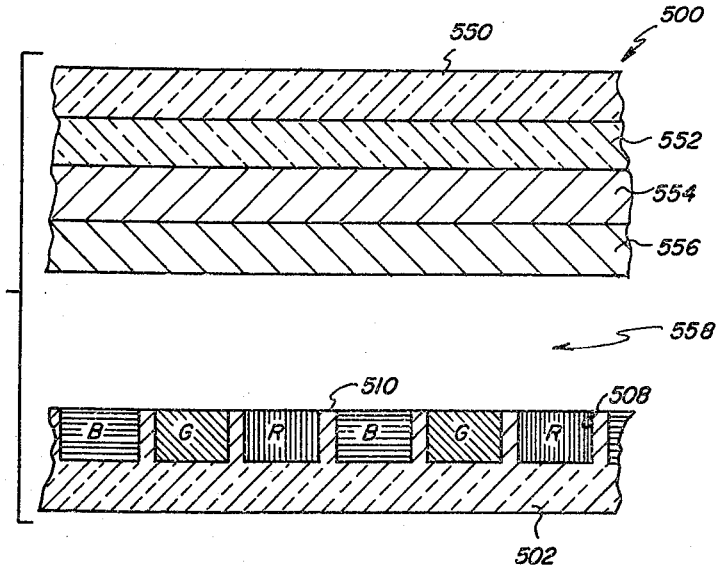

FIG. 5 is a sectional view of a multicolor image transfer element.

DESCRIPTION OF PREFERRED EMBODIMENTS

A support is employed in the practice of this invention having formed therein an array of microcells. The microcells can be similar to those described by Whitmore, cited above, and here incorporated by reference. The portion of the support forming the microcells is sufficiently insulative to permit an electrostatic charge pattern to be formed thereon differentiating one set of microcells from a second, interlaid set of microcells forming the array.

A specific preferred support 100 is schematically illustrated in FIGS. 1A and 1B. The support is comprised of a photoconductive portion 102 which has substantially parallel first and second major surfaces 104 and 106. The photoconductive portion defines a plurality of microcells (or microvessels) 108, which open toward the first major surface. The microcells are defined in the photoconductive portion by an interconnecting network of dyed lateral walls 110 which are integrally joined to a substantially transparent underlying portion 112 so that the photoconductive portion acts as a barrier between adjacent microcells. The underlying portion defines the bottom wall 114 of each microcell.

In addition to the photoconductive portion, the support is formed by a thin, transparent conductive layer 116 and a transparent film base 118. Along at least one lateral edge of the support, not shown, the film base and the conductive layer can extend laterally beyond the photoconductive portion to facilitate attachment of an external conductor to the support. A charge control barrier layer, not shown, can be interposed between the conductive layer and the photoconductive portion. Depending on the choice of conductive materials employed, electrical biasing of a particular polarity can, in some instances, result in charge injection from the conductive layer into the photoconductive portion rendering it conductive. The function of the charge control barrier layer is to intercept and trap injected charge—i.e., electrons or holes. Charge control barrier layers are well known in the art, as illustrated by Dessauer et al U.S. Pat. No. 2,901,348, Gramza et al. U.S. pat. No. 3,554,742, Humphris et al U.S. Pat. No. 3,640,708, and Hodges German OLS No. 1,944,025, the disclosures of which are here incorporated by reference.

Although the support is shown to be comprised of the photoconductive portion, the conductive layer, and the film base, it is appreciated that it may be formed of only the photoconductive portion. For instance, once the microcells are filled to the extent desired, the conductive layer and/or film base can be stripped from the photoconductive portion, leaving it as a separate element. Alternatively, the photoconductive portion can form the entire support and be brought into contact, as required, with an electrode which forms no part of the support. Although the support is shown to be transparent with dyed lateral walls, it can be entirely transparent or entirely reflective—e.g., white. The photoconductive portion can be transparent, and the film base replaced with a conventional photographic paper support. Other variant forms will be readily apparent.

The microcells are located in a predetermined, controlled relationship to each other. The microcells are relatively spaced in a predetermined, ordered manner to form an array. It is usually desirable and most efficient to form the microcells so that they are aligned along at least one axis in the plane of the support surface. For example, microcells in the configuration of hexagons (preferred for arrays containing three interlaid sets of microcells differing in the imaging compositions contained therein), are conveniently aligned along three support surface axes which intersect at 60° angles. It is generally preferred that the microcells be positioned to form a regular pattern. It is recognized that adjacent microcells can be varied in spacing to permit alterations in visual effects and for other purposes. Although FIG. 1A shows regular hexagonal microcells, any polygonal, circular, elliptical, or other predetermined recurring microcell configuration can be employed, as may be convenient.

Although the outer surface of the film base is shown to be planar, it can take other configurations. For example, the outer surface shown to be planar can alternatively be lenticular. In a preferred form lenticules can be aligned and be approximately coextensive with the individual microcells.

For photographic applications it is frequently desirable to form elements containing two or three separate imaging compositions in interlaid sets of microcells. Three interlaid sets of microcells can, for example, contain interlaid segments of additive primary filters, the additive primary colorants forming the filters each being confined to a separate set of microcells. Each additive primary colorant can be formed of a single additive primary dye or pigment or can result from a combination of subtractive primary dyes and/or pigments—e.g., a red colorant can be formed of yellow and magenta colorants. Interlaid filter segments of two colors can be present in the microcells and the dyed lateral walls can provide the third filter. In another form, the separate sets of microcells can contain radiation-sensitive imaging materials, each sensitive to a different portion of the visible spectrum—e.g., blue, green, and red-responsive silver halide emulsions, each confined to a separate set of microcells. In still another form, the three sets of microcells can contain subtractive primary imaging dyes or dye precursors—i.e., cyan, magenta, and yellow imaging dyes or dye precursors, each confined to a separate set of microcells. The microcells can also contain combinations of filter, radiation-sensitive, and dye or dye-precursor materials to form the imaging compositions. As employed herein, the term "imaging composition" indicates one or a combination of materials (including precursors thereof) which can be at least in part viewed in a photographic image produced by the elements.

To illustrate a specific application for the microcellular supports, in FIGS. 2A and 2B a multicolor filter element 200 is illustrated. As shown, the filter element is comprised of a photoconductive support 102 obtained by stripping the photoconductive portion 102 from the conductive layer 116 and from base 118. The lateral walls 110 separating adjacent microcells are dyed to reduce light transmission therethrough while the underlying portions 112 of the support, which form the bottom walls of the microcells, are substantially transparent. As shown, the multicolor filter element is comprised of red, green, and blue filters, each divided into discrete segments R, G, and B. The filter segments are located in first, second, and third sets of microcells in an interlaid pattern.

The multicolor filter element 200 can be employed for additive multicolor imaging, such as illustrated by Dufay U.K. Pat. No. 15,027 (1912), Dufay U.S. Pat. No. 1,003,720, and James, *The Theory of the Photographic Process,* 4th Ed., Macmillan, 1977, p. 335. By exposing through the multicolor filter a panchromatically responsive imaging composition, such as a panchromatically sensitized silver halide emulsion, it is possible to form a multicolor image. For instance, a negative-working silver halide emulsion can produce a multicolor negative image following exposure and development when viewed through the multicolor filter. A direct-positive imaging material will similarly produce a positive multicolor image.

The interlaid pattern of microcells illustrated is particularly advantageous from a visual standpoint, since each filter segment is surrounded by an equal number of segments of each of the two remaining filters. In this way the eye can readily blend the laterally separated filter segments in viewing an image. Also, printing through a multicolor negative image formed by the filters and radiation-sensitive imaging material to form a multicolor positive is facilitated by the spatial relationship of the separate sets of microcells.

It is, of course, recognized that other interlaid patterns of filter segments are possible. For example, instead of being interlaid in the manner shown, the blue, green, and red filter segments can form separate rows of microcells. For instance, a row of filter segments of one color can be interposed between two filter segment rows, one of each of the two remaining additive primary colors. Different interlaid patterns can also occur as a result of devoting unequal numbers of microcells to the different filters. For example, it is recognized that the human eye obtains most of its information from the green portion of the spectrum. Less information is obtained from the red portion of the spectrum, and the least amount of information is obtained from the blue portion of the spectrum. Bayer U.S. Pat. No. 3,971,065 discloses an interlaid additive primary multicolor filter segment pattern in which the green segments occupy half of the total array area, with red and blue filter segments each occupying one half of the remaining area of the filter array. Such filters can be formed by the present invention, if desired.

Dufay and others recognized the desirability of providing segmented interlaid filters in the smallest attainable sizes. Lateral spreading of the materials forming the separate filter segments has, however, posed a limitation on obtaining small filter segments. For example, when colorants from adjacent segments mix, even in edge regions, unwanted shifts in hue can occur. Whitmore, cited above, recognized that lateral spreading can be overcome by placing the filter materials in microcells. The lateral walls 110 of the support 102 form a physical barrier to lateral spreading and mixing of filter materials. Notwithstanding Whitemore's contribution to the art, the present invention provides an improved approach for selectively introducing two or more imaging compositions into interlaid sets of microcells.

It is to be recognized that the supports as shown in the drawings are greatly enlarged and contain some deliberate distortions of relative proportions. Most notably, the microcells have been greatly enlarged for purposes of illustration. In actuality the microcells are intentionally formed of a size that cannot be readily resolved by the unaided human eye, and in general the microcells can only be individually viewed microscopically. Thus, the vast majority of approaches for placing materials in an interlaid set of larger cells are foreclosed to the placement of imaging compositions selectively in interlaid sets of microcells.

The method of the present invention is generally applicable to the formation of elements containing in a first set of microcells a first imaging composition and in at least one other, interlaid set of microcells a different imaging composition. Broadly, this method can be practiced with any microcellular support in which the portion forming the microcells is sufficiently insulative to permit an electrostatic charge to be selectively associated with one set of microcells. For example, the remaining, interlaid microcells can be uncharged or bear an opposite polarity electrostatic charge. The support with a charge pattern corresponding to the distribution of the one set of microcells is brought into contact with a carrier vehicle containing dispersed therein particles of an electrographic imaging composition. As defined herein the term "electrographic" as applied to the imaging composition means that it is capable of forming an image on a support exhibiting an electrostatic charge pattern. By placing an electrostatic charge on the one set of microcells which is opposite in polarity to the charge exhibited by the dispersed particles of the electrographic imaging composition, the charged particles are selectively attracted into the one set of microcells in preference to the remaining set of microcells. One or more differing imaging compositions can be introduced into the remaining microcells by repeating the procedures described above or by any other convenient conventional technique, such as the filling procedures described by Whitmore and Gilmour, cited above.

Figure 3A:
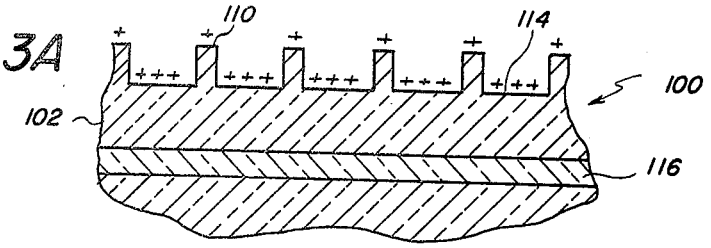

A specific, preferred embodiment of the process of this invention is described by reference to FIGS. 3A through 3D. In FIG. 3A the support 100 is shown with the photoconductive portion 102 bearing on its outer surface a positive electrostatic charge, applied in a nonimagewise manner to provide a substantially uniform charge distribution. It is to be noted that the positive charge not only covers the bottom walls 114 of the microcells, but also covers the upper edges of the lateral walls 110. As is well understood by those skilled in the art, the electrostatic charge can be conveniently applied by passing the support through a corona discharge.

Figure 3B:
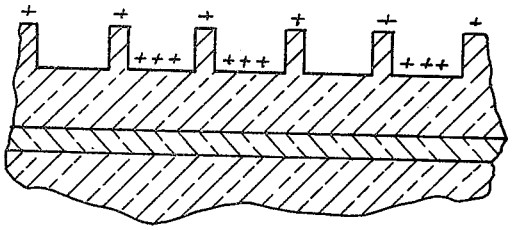

The next step of the process is to remove the electrostatic charge selectively from the bottom walls of a first, interlaid set of microcells without disturbing the electrostatic charge in other areas of the support. This is accomplished by rendering the photoconductive portion 102 of the support conductive in areas corresponding to the bottom walls of the first set of microcells. By grounding or negatively biasing the conductive layer 116, electrostatic charge can be conducted through the conductive areas of the photoconductive portion leaving the bottom walls of the first set of microcells substantially discharged, as shown in FIG. 3B.

The photoconductive portion can be rendered conductive in areas corresponding to the first set of microcells by supplying radiant energy to which the photoconductive portion is responsive to these areas. According to a preferred technique a laser beam of a wavelength to which the photoconductive portion is sensitive is sequentially aimed at the microcells forming the first set. This can be done by known laser scanning techniques, such as illustrated by Marcy U.S. Pat. No. 3,732,976, Dillon et al. U.S. Pat. No. 3,864,697, and Starkweather et al. U.S. published patent application B309,860. The width of the laser beam can be adjusted to expose a plurality of adjacent microcells, but it is preferably less than the width of a single microcell, so that the microcells can be individually addressed.

Following a specific, preferred technique two lasers are employed. One of the lasers is chosen to provide the desired alteration in conductivity. The second laser is used only to position accurately the first laser. It is preferred of a wavelength to which the photoconductive portion is less responsive and can be of lesser intensity. The first and second laser beams are laterally displaced in the plane of the support by an accurately determnined distance. By employing a photodetector to receive light transmitted through or reflected from the support from the second laser, it can be determined when a microcell or a lateral wall is aligned with the first laser beam. In the illustrated preferred form, in which the microcell bottom walls are substantially transparent and the lateral walls are dyed, a substantial change in light intensity sensed by the photodetector will occur as a function of the relative position of the support and laser beam. In other instances differences in reflection or refraction between the bottom and lateral walls forming the microcells can be relied upon to provide information to the photodetector. Once the position of the second laser with respect to a microcell can be ascertained, the position of the first laser with respect to a microcell can also be ascertained, since the spacing between the lasers and the center-to-center spacings of the microcells are known. Depending upon the pattern and accuracy of exposure desired, indexing with the second laser can be undertaken before exposing each microcell with the first laser, only once at the beginning of exposure of one microcell set, or at selected intermediate intervals, such as before each row of microcells of one set is exposed.

When a first laser scan is completed, the support is left with one uncharged microcell set while the remaining interlaid microcell sets are substantially undisturbed. Instead of sequentially laser exposing the microcells in the manner indicated, exposure through a mask can be undertaken by well known techniques. Laser scanning exposure offers the advantages of eliminating any need for mask preparation and alignment with respect to the microcells.

Figure 3C:
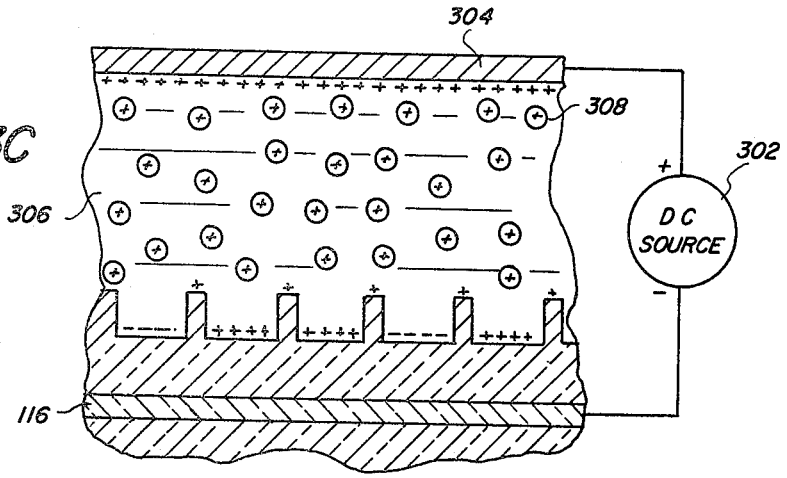
Figure 3D:
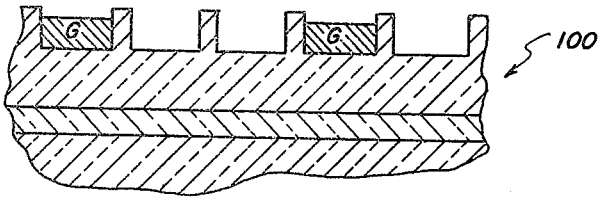

To introduce a first imaging composition selectively into the first set of microcells, a development procedure can be employed as illustrated in FIG. 3C. A direct current source 302 is connected between a development electrode 304 and the conductive layer 116 of the support so that the development electrode is positively biased with respect to the conductive layer 116. An electrographic developer containing a carrier liquid 306 and dispersed positively charged particles 308 of an electrographic imaging composition is interposed between the development electrode and the support 100 so that it can enter the microcells. The positive bias on the development electrode can be viewed as inducing a negative electrostatic charge on the bottom walls of the first set of microcells. (See Schaffert, *Electrophotography*, John Wiley & Sons, New York, p. 16.) The positively charged dispersed particles of electrographic imaging composition are therefore selectively attracted into the first set of microcells while being concurrently repelled from the remaining microcells, which contain a positive electrostatic charge. In FIG. 3D a first set of microcells of the support 100 are shown partially filled with a green electrographic imaging composition.

To complete the preparation of an element containing green, red, and blue imaging compositions in first, second, and third interlaid sets of microcells, the procedure described above can be twice repeated, except that the second and third sets of microcells are selectively laser addressed in second and third repetitions and a different electrographic imaging composition is employed in each instance. Where the first and second sets of microcells are substantially filled, the third set of microcells can be filled by any of the techniques for filling microcells with a single imaging composition, for as doctor blade coating, for example, since the third imaging composition cannot enter the first and second sets of microcells in any significant quantity. The second and third sets of microcells can be filled using any of the imaging compositions and filling procedures disclosed by Whitmore and Gilmour, cited above.

It is an unexpected advantage of the present invention that, when the procedure of this invention described above is repeated, second and subsequent electrographic imaging compositions do not enter the set or sets of microcells which have already received an electrographic imaging composition. Surprisingly, this is true evenif the first set of microcells is not entirely filled and even if the first set of microcells is again exposed to radiation, either intentionally or inadvertently, in rendering the photoconductive portion conductive in the areas of the second and subsequent sets of microcells. This effect is hereinafter referred to as the exclusion effect. Hercock et al. U.S. Pat. No. 3,748,125 reports exclusion effects for xerographic toners of specific compositions applied to planar photoconductive surfaces. The exclusion effect observed in the practice of this process does not appear related to any specific choice of electrographic imaging compositions. Without wishing to be bound by any particular theory to account for the exclusion effect observed, it may result from photoconductive surface masking by the already deposited imaging compositions, field gradient or fringing effects (influenced to a degree by the nonplanar configuration of the photoconductive surface), or, most probably, some combination of these effects.

The exclusion effect facilitates the formation of interlaid patterns without introducing more than one electrographic imaging comosition into any one set of microcells. This can be illustrated by reference to FIG. 4. The multicolor filter 400 can be formed by introducing into a first set of microcells a green electrographic imaging composition, as has been described above in connection with FIGS. 3A through 3D. It is to be noted that the microcells labeled G, which each contain a green filter segment lie in alternate rows of microcells. This offers the advantage of allowing uninterrupted laser scanning of entire rows of microcells rather than addressing individual microcells, as required for the pattern of FIG. 2A, for example. After introducing the green electrographic imaging composition, rotating the support 60°, and again nonimagewise electrostatically charging the photoconductive portion of the support, the laser can uninterruptedly scan alternate rows of microcells. During this second laser scan, the laser beam crosses the microcells already containing the green electrographic imaging composition. Because of the exclusion effect, however, during development with a red electrographic imaging composition, only the microcells which are both laser addressed and free of the first, green imaging composition receive the red electrographic imaging composition. To introduce the third, blue imaging composition into the microcells remaining forming the third set, the laser scanning procedure employed for the second laser scan is repeated addressing now the alternate rows skipped during the second scan. Following development with a blue electrographic imaging composition, the result is the filter segment pattern shown in FIG. 4. It is to be noted that an interlaid pattern is obtained in which both red and blue filter segments are entirely surrounded by filter segments of the remaining two sets. Yet this result is obtained with only uninterrupted linear scanning by the laser, thereby significantly decreasing the amount of laser indexing which would be required in the absence of the exclusion effect.

It is to be appreciated that the description of the process of this invention by reference to FIGS. 3A through 3D and 4 is merely illustrative of certain preferred embodiments. Numerous variations will readily occur to those skilled in the art of electrophotography, once the invention is appreciated. For example, the polarity of charge on the photoconductive portions, electrographic imaging composition particles, and development electrode can be reversed without the exercise of invention. The use of a development electrode is not required. Reversal development through field fringing is known to be obtainable for small areas, such as line copy. Further, it is possible to choose the polarity of the electrographic imaging composition particles so that it is opposite that of the electrostatic charge on the photoconductive portion and therefore attracted to the remaining charged microcells not exposed rather than the microcells which are exposed. In such an alternative, initial laser scanning covers the entire surface of the photoconductive portion, except the area represented by the first set of microcells. Any conventional electrographic imaging composition particle size capable of entering the individual microcells can be employed. It is preferred to employ particle sizes of less than about 25 percent of the width of the microcells. Although electrographic developers containing liquid carrier vehicles are preferred, since smaller particle sizes compatible with the widths of the microcells are more readily employed, any conventional electrographic development technique, such as the use of aerosols and dry toners, can be employed. Liquid electrographic developers are particularly preferred which require no separate fusing step to hold the electrographic imaging composition particles in place in the microcells. A separate fusing step can be employed where all of the components of the electrographic imaging composition are intended to remain permanently in the microcells, as in a simple multicolor filter, such as 200 or 400, but it is preferred to avoid a separate fusing step intended to produce a high degree of fusing where one or more materials are to be removed from the microcells. Conventional biasing voltages are generally suitable for the practice of this process.

In using the multicolor filter elements 200 or 400 described above a panchromatic radiation-sensitive material can be employed as a continuous layer coated on a separate support and form no part of the filter element, simply being juxtaposed with the filter element during exposure and viewing. In another form, the panchromatic radiation-sensitive material can form a separate continuous layer coated over the first major surface of the support. In still another variant form, the panchromatic radiation-sensitive material can lie in each of the microcells so that the filter segments lie between the imaging material and the bottom walls of the microcells. The radiation-sensitive material can even form a part of the imaging compositions. Where the radiation-sensitive material is blended with the filter colorants, it is preferred to incorporate a selectively blue responsive radiation-sensitive material in the microcells containing blue filter colorant, a selectively green responsive radiation-sensitive material in the microcells containing green filter colorant, and a selectively red responsive radiation-sensitive material in the microcells containing red filter colorant. The three radiation-sensitive materials can be introduced along with the filter colorants as described above, except that the radiation-sensitive materials should be protected against inadvertent exposure to actinic radiation.

The use of subtractive primary dyes or dye precursors in interlaid sets of microcells can be appreciated by reference to FIG. 5. A multicolor image transfer photographic element 500 is shown. The transparent support 502, the microcells 508, and the lateral walls 510 can be identical to corresponding features in elements 200 and 400, described above. The microcells contain filter materials and radiation-sensitive imaging materials as described above. In addition each of the microcells is provided with a subtractive primary dye precursor which can be shifted between a mobile and an immobile form either in its dye or dye precursor form. The microcells R, the microcells G, and the microcells B are provided with mobile cyan, magenta, and yellow dye precursors, respectively. The support 502 together with the contents of the microcells form an image generating portion of the photographic element. For purposes of illustration, the photographic element is hereinafter described in terms of a preferred embodiment in which a red responsive silver halide emulsion is present in microcells R, a green responsive silver halide emulsion is present in microcells G, and a blue responsive silver halide emulsion is present in microcells B, each emulsion being blended with an additive primary filter material and a complementary subtractive primary dye precursor.

An image-receiving portion of the photographic element is comprised of a transparent support (or cover sheet) 550 on which is coated a conventional dye immobilizing layer 552. A reflection and spacing layer 554, which is preferably white, is coated over the immobilizing layer. A silver reception layer 556, which contains a silver precipitating agent, overlies the reflection and spacing layer.

In a preferred, integral construction of the photographic element the image-generating and image-receiving portions are joined along their edges and lie in face-to-face relationship. After imagewise exposure a processing solution is released from a rupturable pod, not shown, integrally joined to the image-generating and receiving portions along one edge thereof. A space 558 is indicated between the image-generating and receiving portions to indicate the location of the processing solution when present after exposure. The processing solution contains a silver halide solvent. A silver halide developing agent is contained in either the processing solution or in a position contacted by the processing solution upon its release from the rupturable pod. The developing agent or agents can be incorporated in the silver halide emulsions.

The photographic element 500 is preferably a positive-working image transfer system and is described by reference to such a system. In such a system the silver halide emulsions are preferably negative-working and the dye precursors are positive-working, although direct-positive emulsions and negative-working dye precursors also product a positive-working image transfer system.

The photographic element 500 is imagewise exposed through the transparent support 502. The red, green, and blue filters do not interfere with imagewise exposure, since they absorb in each instance primarily only outside that portion of the spectrum to which the emulsion with which they are associated is sensitized. The filters can, however, perform a useful function in protecting the emulsions from exposure outside the intended portion of the spectrum. For instance, where the emulsions exhibit substantial native blue sensitivity, the red and green filters can be relied upon to absorb light so that the red- and green-sensitized emulsions are not imaged by blue light.

Upon release of processing solution between the image-forming and receiving portions of the element, silver halide development is initiated in the microcells containing exposed silver halide. Silver halide development within a microcell results in one exemplary form in a selective immobilization of the initially mobile dye precursor present. In a preferred form the dye precursor is both immobilized and converted to a subtractive primary dye of a hue complementary to the filter. The residual mobile imaging dye precursor, either in the form of a dye or a precursor, migrates through the silver reception layer 556 and the reflection and spacing layer 554 to the dye immobilizing layer 552. In passing through the silver reception and spacing layers the mobile subtractive primary dyes or precursors are free to and do spread laterally. Referring to FIG. 2A, for example, it can be seen that each microcell containing a selected subtractive primary dye precursor is surrounded by microcells containing precursors of the remaining two subtractive primary dyes. It can thus be seen that lateral spreading results in overlapping transferred dye areas in the dye immobilizing layer of the receiver when mobile dye or precursor is being transferred from adjacent microcells. Where three subtractive primary dyes overlap in the receiver, black image areas are formed, and where no dye is present, white areas are viewed due to the reflection from the spacing layer. Where two of the subtractive primary dyes overlap at the receiver an additive primary image area is produced. Thus, it can be seen that a positive multicolor dye image can be formed which can be viewed through the transparent support 550. The positive multicolor transferred dye image so viewed is right-reading.

In the multicolor photographic element 500 the risk of undesirable interimage effects attributable to wandering oxidized developing agent is substantially reduced as compared to conventional multicolor photographic elements having superimposed color-forming layer units since the lateral walls 510 prevent direct lateral migration between adjacent reaction microcells. Nevertheless, the oxidized developing agent in some systems can be mobile and can migrate with the mobile dye or dye precursor toward the receiver and migrate back to an adjacent microcell. To minimize unwanted dye or dye precursor immobilization prior to its transfer to the dye immobilizing layer of the receiver, it is preferred to incorporate in the silver reception layer 556 a conventional oxidized developing agent scavenger.

Since the processing solution contains silver halide solvent, the residual silver halide not developed in the microcells is solubilized and allowed to diffuse to the adjacent silver reception layer. The dissolved silver is physically developed in the silver reception layer. Solubilization and transfer of the silver halide from the microcells operates to limit direct or chemical development of silver halide occurring therein. It is well recognized by those skilled in the art that extended contact between silver halide and a developing agent under development conditions (e.g., at an alkaline pH) can result in an increase in fog levels. By solubilizing and transferring the silver halide a mechanism is provided for terminating silver halide development in the microcells. In this way production of oxidized developing agent is terminated and immobilization of dye in the microcells is also terminated. Thus, a very simple mechanism is provided for terminating silver halide development and dye immobilization.

In addition to obtaining a viewable transferred multicolor positive dye image a useful negative multicolor dye image is obtained. In microcells where silver halide development has occurred an immobilized subtractive primary dye is present. This immobilized imaging dye together with the additive primary filter colorant offer a substantial absorption throughout the visible spectrum, thereby providing a high neutral density to these microcells. For example, where an immobilized cyan dye is formed in a microcell also containing a red filter colorant, it is apparent that the cyan dye absorbs red light while the red filter colorant absorbs in the blue and the green regions of the spectrum. The developed silver present in the microcell also increases the neutral density. In microcells in which silver halide development has not occurred, the mobile dye precursor, either before or after conversion to a dye, has migrated to the receiver. The sole color present then is that provided by the filter colorant. It is a distinct advantage in reducing minimum density to employ the silver reception layer 556 to terminate silver halide development as described above rather than to rely on other development termination alternatives. If the image-generating portion of the photographic element 500 is separated from the image-receiving portion, it is apparent that the image-generating portion forms in itself an additive primary multicolor negative of the exposure image. The additive primary negative image can be used for either transmission or reflection printing to form right-reading multicolor positive images, such as enlargements, prints and transparencies, by conventional photographic techniques.

The foregoing description of photographic element 500 illustrates the use of initially mobile subtractive primary dye precursors in addition to additive primary filter materials and red, green, and blue responsive silver halide emulsions in interlaid sets of microcells. In alternative multicolor image transfer photographic elements the microcells can contain the silver halide precipitating agent in the microcells and a single panchromatically sensitized silver halide emulsion can be coated to overlie the other contents of the microcells, either in or above the microcells. The subtractive primary dye precursors can either be initially mobile or immobile. Further, either mobile or immobile subtractive primary dyes capable of undergoing imagewise alterations in mobility can be substituted for the dye precursors. In this instance it is preferred to locate the subtractive primary dyes in the microcells so that exposing radiation strikes the silver halide before the dye, thereby avoiding competing absorption and any resulting decrease in speed. In still another variant form preformed image dyes can be shifted in hue so that they do not compete with silver halide in absorbing light to which silver halide in the same microcell is responsive. The dyes can shift back to their desired image hue upon contact with processing solution. If no additive multicolor retained image is desired, the additive primary filter materials can be omitted from the microcells in those instances where the silver halide in each set of microcells is responsive to only one of the blue, green, and red portions of the spectrum. If no transferred multicolor dye image is desired, the layer 556 can be substituted for the layer 552 so that a transferred silver image can be viewed while all subtractive primary dyes or dye precursors can be omitted. Of course, if no transferred dye or silver image is desired, the entire image receiving portion of the photographic element as well as the subtractive primary dye or dye precursor can be omitted. It is therefore apparent that a wide variety of different materials can be employed to form interlaid sets of microcells useful in even a specific application, such as multicolor photography. Specific illustrations of preferred multicolor image transfer systems that can be formed according to the present invention are set forth below.

In one specific, illustrative form the photographic element 500 can contain (1) in a first set of microcells a blue filter dye or pigment and an initially colorless, mobile yellow dye-forming coupler, (2) in a second, interlaid set of microcells a green filter dye or pigment and an initially colorless, mobile magenta dye-forming oupler and (3) in a third, interlaid set of microcells a red filter dye or pigment and an initially colorless, mobile cyan dye-forming coupler. In a preferred form a panchromatically sensitized neagtive-working silver halide emulsion (not shown in FIG. 5) is coated over the microcells. The layer 556 contains a silver precipitating agent and an oxidized developing agent scavenger. The reflection and spacing layer 554 can be a conventional titanium oxide pigment containing layer. The dye immobilizing layer 552 contains a substantially immobile oxidizing agent.

The photographic element 500 so constituted is first exposed imagewise through the transparent support 502. Thereafter a processing composition containing a color developing agent and a silver halide solvent is released and uniformly spread in the space 558. In exposed areas silver halide is developed producing oxidized color developing agent which couples with the dye forming coupler present to form an immobile dye. The filter dye or pigment, the immobile dye formed, and the developed silver thus together increase the optical density of the microcells which are exposed.

In areas not exposed, the undeveloped silver halide is solubilized by the silver halide solvent and migrates to the layer 556 where it is reduced to silver. Any oxidized developing agent produced in reducing the silver halide to silver immediately cross-oxidizes with the oxidized developing agent scavenger which is present with the silver precipitating agent in the layer 556.

At the same time mobile coupler is wandering from microcells which were not exposed. The mobile coupler does not react with oxidized color developing agent in the layer 556, since any oxidized color developing agent present preferentially reacts with the scavenger. The coupler thus migrates through layer 556 unaffected and enters reflection and spreading layer 554. Because of the thickness of this layer, the mobile coupler is free to wander laterally to some extent. Upon reaching the immobilizing layer 552, the coupler reacts with oxidized color developing agent. The oxidized color developing agent is produced uniformly in this layer by interaction of oxidizing agent with the color developing agent. Due to lateral diffusion in the spreading layer, superimposed immobile yellow, magenta, the cyan dye images are formed in the immobilizing layer and can be viewed as a multi-color image through the transparent support (or cover sheet) 550 with the layer 554 providing a white reflective background. At the same time, since only filter dye or pigment remains in the unexposed microcells, a useable additive primary negative transparency is formed by the support 502.

To illustrate a variant system, a photographic element as described immediately above can be modified by substituting for the initially colorless, mobile dye forming couplers initially mobile dye developers. The dye developers are shifted in hue, so that the dye developer present in the microcells containing red, green, and blue filters do not initially absorb light in the red, green, and blue regions of the spectrum, respectively. A dye mordant as well as an oxidant can be present in the dye immobilizing layer 552. Since the dye image forming material is itself a silver halide developing agent, a conventional activator solution can be employed (preferably containing an electron transfer agent). The remaining features can be identical to those described in the preceding embodiment.

Upon imagewise exposure and release of the activator solution, dye developer reacts with exposed silver halide to form an immobile subtractive primary dye which is a complement of the additive primary filter material in the exposed mircocell. Thus the optical density of exposed microcells is increased, and a negative multicolor additive primary image can be formed in the support 502 by the filter materials. Silver halide development is terminated by transfer of solubilized silver halide as has already been described. In unexposed areas unoxidized dye developer migrates to the immobilizing layer 552 where it is immobilized to form a multicolor positive image. During processing the dye developers shift in hue so that they form subtractive primaries complementary in hue to the additive primary filter materials with which they are initially associated in the microcells. That is, the red, green and blue filter material containing microcells contain dye developers which ultimately form cyan, magenta, and yellow image dyes. Hue shifts can be brought about by the higher pH of processing, by mordanting, or by associating the image dye in the receiver with a chelating material.

Instead of using shifted dye developers as described above, initially mobile leuco dyes can be employed in combination with electron transfer agents to produce essentially similar results. Sice the leuco dyes are initially colorless, hue shifting does not have to be undertaken to avoid competing light absorption during imagewise exposure. The leuco dyes are converted to subtractive primary imaging dyes upon oxidation in the dye immobilizing layer.

Instead of employing initially mobile dyes or dye precursors as described above, it is possible to employ initially immobile materials. In one specific preferred form benzisoxazolone precursors of hydroxylamine dye-releasing compounds are employed. Upon cross-oxidation in the microcells with oxidized electron transfer agent produced by development of exposed silver halide, release of mobile dye is prevented. In areas in which silver halide is not exposed and no oxidized electron transfer agent is produced mobile dye release occurs. The dye image providing compounds are preferably initially shifted in hue to avoid competing absorption during imagewise exposure. Mordant immobilizes the dyes in the layer 552. No oxidant is required in this layer in this embodiment. Except as indicated, this element and its function are similar to the illustrative embodiments described above.

Each of the illustrative embodiments described above employ positive-working dye image providing compounds. To illustrate a specific embodiment employing negative-working dye image providing compounds, a first set of microcells 508 can contain a blue filter dye or pigment, a silver ion complex precipitating agent and a redox dye-releaser containing a yellow dye which is shifted in hue to avoid adsorption in the blue region of the spectrum prior to processing. In like manner a second, interlaid set of microcells contains a green filter dye or pigment, the silver precipitating agent, and a redox dye-releaser containing a analogously shifted magenta dye, and a third, interlaid set of microcells containing a red filter dye or pigment, the silver precipitating agent, and a redox dye-released contains an analogously shifted cyan dye. The microcells are overcoated with a panchromatically sensitized silver halide emulsion layer containing an oxidized developing agent scavenger (not shown in FIG. 5). The silver precipitating layer 556 shown in FIG. 5 is not present. The reflection and spreading layer is a white titanium oxide pigment layer. The dye immobilizing layer 552 contains a mordant.

The photographic element is imagewise exposed through the transparent support 502. A precessing solution containing an electron transfer agent and a silver halide solvent is spread between the image generating and the image receiving portions of the element. In a preferred form the pH of the processing solution causes the redox dye-releasers to shift to their desired image-forming hues. In areas in which silver halide is exposed oxidized electron transfer agent produced by development of exposed silver halide immediately cross-oxidizes with the scavenger. Thus, in microcells corresponding to exposed silver halide the redox dye-releasers remain unaltered in their initially immobile form. In areas in which silver halide is not exposed, silver halide solvent present in the processing solution solubilizes silver halide allowing it to form soluble silver ion complex (e.g., $AgSO_3-$) capable of wandering into the underlying microcells. In the microcells physical development of solubilized silver halide occurs producing silver and oxidized electron transfer agent. The oxidized electron transfer agent interacts with the redox dye-releaser to release mobile dye which is transferred to the layer 552 and immobilized by the mordant. A multicolor positive transferred image is produced in the layer 552 comprised of yellow, magenta, and cyan transferred dyes. A multi-color positive retained image can also be produced, since (1) the silver density produced by chemical development in the emulsion layer is small compared to the silver density produced by physical development in the microcells and (2) with the image generating portion separated from the image receiving portion the redox dye-releasers remaining in their initial, immobile condition in the microcells can be uniformly reacted with an oxidizing agent to release mobile dye which can be removed from the microcells by washing.

In each of the preferred forms of the image transfer element 500 described above, the microcells 508 form three separate interlaid sets each containing a differing imaging composition. Each of the imaging compositions contains one or more immobile colorants collectively capable of producing an additive primary color and a subtractive primary dye or dye precursor capable of shifting between a mobile and an immobile form as a function of silver halide development, hereinafter collectively referred to as a colorant portion. The preferred forms of the photographic element 500 can be produced by procedures essentially similar to those described by reference to FIGS. 3A through 3D, above, using at least one and preferably three separate electrographic imaging compositions.

In one respect this invention is directed to certain preferred electrographic imaging compositions comprised of a colorant portion, as described above, and from 0.1 to 10 (preferably 0.3 to 3.0) parts by weight per part of the colorant portion of a resinous portion capable of forming a particulate dispersion with the colorant portion in a liquid carrier vehicle having a dielectric constant of less than 3.0 and a resistivity of at least $10^{10}$ ohm-cm. At least one of the colorant and resinous portions is chosen to impart an electrostatic charge of a selected polarity to the particulate dispersion in the liquid carrier.

Specific subtractive primary dyes and dye precursors capable of shifting between a mobile and an immobile form as a function of silver halide development can be selected from among a wide variety of such materials known to be useful in conventional dye image transfer systems. For example, ballasted dye-forming (chromogenic) or nondye-forming (nonchromogenic) couplers having a mobile dye attached at a coupling-off site can be employed. Upon coupling with an oxidized color developing agent, such as a para-phenylenediamine, the mobile dye is displaced so that it can transfer to a receiver. The use of such negative-working dye image providing compounds is illustrated by Whitmore et al. U.S. Pat. No. 3,227,550, Whitmore U.S. Pat. No. 3,227,552, and Fujiwhara et al., U.K. Pat. No. 1,445,797, the disclosures of which are here incorporated by reference.

In a preferred image transfer system redox dye releasers can be employed as negative-working dye image providing compounds. A cross-oxidizing developing agent (electron transfer agent) develops silver halide and then crossoxidizes with a compound containing a dye linked through an oxidizable sulfonamido group, such as a sulfonamidophenol, sulfonamidoaniline, sulfonamidoanilide, sulfonamidopyrazolobenzimidazole, sulfonamidoindole, or sulfonamidopyrazole. Following cross-oxidation hydrolytic deamidation cleaves the mobile dye with the sulfonamido group attached. Such systems are illustrated by Fleckenstein U.S. Pat. Nos. 3,928,312 and 4,053,312, Fleckenstein et al. U.S. Pat. No. 4,076,529, Melzer et al. U.S. Pat. No. 4,110,113, Degauchi U.S. Pat. No. 4,199,892, Koyama et al. U.S. Pat. No. 4,055,428, Vetter et al. U.S. Pat. No. 4,198,235, and Kestner et al. *Research Disclosure,* Vol. 151, Nov. 1976, Item 15157. Also specifically contemplated are otherwise similar systems which employ an immobile, dye-releasing (a) hydroquinone, as illustrated by Gompf et al. U.S. Pat. No. 3,698,897 and Anderson et al. U.S. Pat. No. 3,725,062, (b) para-phenylenediamine, as illustrated by Whitmore et al., Canadian Pat. No. 602,607, or (c) quaternary ammonium compound, as illustrated by Becker et al. U.S. Pat. No. 3,728,113.

Another specifically contemplated dye image transfer system which employs negative-working dye image providing compounds reacts an oxidized electron transfer agent or, specifically, in certain forms, an oxidized para-phenylenediamine with a ballasted phenolic coupler having a dye attached through a sulfonamido linkage. Ring closure to form a phenazine releases mobile dye. Such an imaging approach is illustrated by Bloom et al. U.S. Pat. Nos. 3,443,939 and 3,443,940.

In still another image transfer system employing negative-working dye image providing compounds, ballasted sulfonylamidrazones, sulfonylhydrazones or sulfonylcarbonylhydrazides can be reacted with oxidized para-phenylenediamine to release a mobile dye to be transferred, as illustrated by Puschel et al. U.S. Pat. Nos. 3,628,952 and 3,844,785. In an additional negative-working system a hydrazide can be reacted with silver halide having a developable latent image site and thereafter decompose to release a mobile, transferable dye, as illustrated by Rogers U.S. Pat. No. 3,245,789, Kohara et al. *Bulletin Chemical Society of Japan,* Vol. 43, pp. 2433–37, and Lestina et al. *Research Disclosure,* Vol. 28, Dec. 1974, Item 12832.

The foregoing image transfer systems all employ negative-working dye image providing compounds which are initially immobile and contain a preformed dye which is split off during imaging. The released dye is mobile and can be transferred to a receiver. Positive-working, initially immobile dye image providing compounds which split off mobile dyes are also known. For example, it is known that when silver halide is imagewise developed the residual silver ions associated with the undeveloped silver halide can react with a dye substituted ballasted thiazolidine to release a mobile dye imagewise, as illustratrated by Cieciuch et al U.S. Pat. No. 3,719,489 and Rogers U.S. Pat. No. 3,443,941.

Preferred positive-working, initially immobile dye image providing compounds are those which release mobile dye by intramolecular nucleophilic displacement reactions. The compound in its initial form is hydrolyzed to its active form while silver halide development with an electron transfer agent is occurring. Cross-oxidation of the active dye-releasing compound by the oxidized electron transfer agent prevents intramolecular nucleophilic release of the dye moiety. Benzioxazolone precursors of hydroxylamine dye-releasing compounds are illustrated by Hinshaw et al U.S. Pat. No. 4,199,354, and *Research Disclosure,* Vol. 144, April 1976, Item 14447. N-Hydroquinonyl carbamate dye-releasing compounds are illustrated by Fields et al U.S. Pat. No. 3,980,479. It is also known to employ an immobile reducing agent precursor (electron donor precursor) in combination with an immobile ballasted electron-accepting nucleophilic displacement (BEND) compound which, on reduction, anchimerically displaces a diffusible dye. Hydrolysis of the electron donor precursor to its active form occurs simultaneously with silver halide development by an electron transfer agent. Cross-oxidation of the electro donor with the oxidized electron transfer agent prevents further reaction. Cross-oxidation of the BEND compound with the residual, unoxidized electron donor then occurs. Intramolecular nucleophilic displacement of mobile dye from the reduced BEND compound occurs as part of a ring closure reaction. An image transfer system of this type is illustrated by Chasman et al. U.S. Pat. No. 4,139,379.

Other positive-working systems employing initially immobile, dye-releasing compounds are illustrated by Rogers U.S. Pat. No. 3,185,567 and U.K. Pat. Nos. 880,233 and 880,234.

A variety of positive-working, initially mobile dye image providing compounds can be imagewise immobilized by reduction of developable silver halide directly or indirectly through an electron transfer agent. Systems which employ mobile dye developers, including shifted dye developers, are illustrated by Rogers U.S. Pat. Nos. 2,774,668 and 2,983,606, Idelson et al U.S. Pat. No. 3,307,947, Dershowitz et al U.S. Pat. No. 3,230,085, Cieciuch et al. U.S. Pat. No. 3,579,334, Yutzy U.S. Pat. No. 2,756,142, Harbison Def. Pub. T889,017, and Bush et al U.S. Pat. No. 3,854,945. In a variant form a dye moiety can be attached to an initially mobile coupler. Oxidation of a para-phenylenediamine or hydroquinone developing agent can result in a reaction between the oxidized develping agent and the dye containing a coupler to form an immobile compound. Such systems are illustrated by Rogers U.S. Pat. Nos. 2,774,668 and 3,087,817, Greenhalgh et al U.K. Pat. Nos. 1,157,501–506, Puschel et al U.S. Pat. No. 3,844,785, Stewart et al U.S. Pat. No. 3,653,896, Gehin et al French Pat. No. 2,287,711, and *Research Disclosure,* Vol. 145, May 1976, Item 14521.

Other image transfer systems employing positive-working dye image providing compounds are known in which varied immobilization or transfer techniques are employed. For example, a mobile developer-mordant can be imagewise immobilized by development of silver halide to imagewise immobilize an initially mobile dye, as illustrated by Haas U.S. Pat. No. 3,729,314. Silver halide development with an electron transfer agent can produce a free radical intermediate which causes an initially mobile dye to polymerize in an imagewise manner, as illustrated by Pelz et al U.S. Pat. No. 3,585,030 and Oster U.S. Pat. No. 3,019,104.

A number of image transfer systems employing positive-working dye image providing compounds are known in which dyes are not initially present, but are formed by reactions occurring in the photographic element or receiver following exposure. For example, mobile coupler and color developing agent can be imagewise reacted as a function of silver halide development to produce an immobile dye while residual developing agent and coupler are transferred to the receiver and the developing agent is oxidized to form on coupling a transferred immobile dye image, as illustrated by Yutzy U.S. Pat. No. 2,756,142, Greenhalgh et al U.K. Pat. Nos. 1,157,501–'506, and Land U.S. Pat. Nos. 2,559,643, 2,647,049, 2,661,293, 2,698,244, and 2,698,798. In a variant form of this system the coupler can be reacted with a solubilized diazonium salt (or azosulfone precursor) to form a diffusible azo dye before transfer, as illustrated by Viro et al U.S. Pat. No. 3,837,852. In another variant form a single, initially mobile coupler-developer compound can participate in intermolecular self-coupling at the receiver to form an immobile dye image, as illustrated by Simon U.S. Pat. No. 3,537,850 and Yoshiniobu U.S. Pat. No. 3,865,593. In still another variant form a mobile amidrazone is present with the mobile coupler and reacts with it at the receiver to form an immobile dye image, as illustrated by Janssens et al U.S. Pat. No. 3,939,035. Instead of using a mobile coupler, a mobile leuco dye can be employed. The leuco dye reacts with oxidized electron transfer agent to form an immobile product, while unreacted leuco dye is transferred to the receiver and oxidized to form a dye image, as illustrated by Lestina et al U.S. Pat. Nos. 3,880,658, 3,935,262, and 3,935,263, Cohler et al U.S. Pat. No. 2,892,710, Corley et al U.S. Pat. No. 2,992,105, and Rogers U.S. Pat. Nos. 2,909,430 and 3,065,074. Mobile quinone heterocyclammonium salts can be immobilized as a function of silver halide development and residually transferred to a receiver where conversion to a cyanine or merocyanine dye occurs, as illustrated by Bloom U.S. Pat. Nos. 3,537,851 and '852.

Image transfer systems employing negative-working dye image providing compounds are also known in which dyes are not initially present, but are formed by reactions occurring in the photographic element or receiver following exposure. For example, a ballasted coupler can react with color developing agent to form a mobile dye, as illustrated by Whitmore et al U.S. Pat. No. 3,227,550, Whitmore U.S. Pat. No. 3,227,552, Bush et al U.S. Pat. No. 3,791,827, and Viro et al U.S. Pat. No. 4,036,643. An immobile compound containing a coupler can react with oxidized para-phenylenediamine to release a mobile coupler which can react with additional oxidized para-phenylenediamine before, during or after release to form a mobile dye, as illustrated by Figueras et al. U.S. Pat. No. 3,734,726 and Janssens et al German OLS No. 2,317,134. In another form a ballasted amidrazone reacts with an electron transfer agent as a function of silver halide development to release a mobile amidrazone which reacts with a coupler to form a dye at the receiver, as illustrated by Ohyama et al. U.S. Pat. No. 3,933,493.

Where oxidation at the receiver is relied upon to produce an immobile transferred dye image, the receiver can contain as a continuous layer or in microvessels an oxidizing agent. Exemplary useful oxidants for such applications include borates, persulfates, ferricyanides, periodates, perchlorates, triiodides, permanganates, dichromates, manganese dioxide, silver halides, benzoquinones, naphthoquinones, disulfides, nitroxyl compounds, heavy metal oxidants, heavy metal oxidant chelates, N-bromo-succinimides, nitroso compounds, ether peroxides, and the like. The oxidants are preferably chosen from among those of sufficient molecular bulk to be substantially immobile and thereby confined during processing to the receiver. Exemplary preferred immobile oxidants are the immobile nitroxyl compounds disclosed by Ciurca et al. U.S. Pat. No. 4,088,488. Other useful immobile oxidants can be chosen from among those described in the patents cited above disclosing oxidation at a receiver to form a dye. Where oxidation does not in itself result in the formation of an immobile dye, as where the oxidant's primary function is to form a dye, rather than immobilization, a combination of oxidant and a mordant or other immobilizing agent can be present in the dye image providing layer.

Mordants employed to immobilize dyes in the practice of this invention can be chosen from a variety of known mordants. Examples of useful mordants include the following: Sprague et al. U.S. pat. No. 2,548,564, Weyerts U.S. Pat. No. 2,548,575, Carroll et al. U.S. Pat. No. 2,675,316, Yutzy et al. U.S. Pat. No. 2,713,305, Saunders et al. U.S. Pat. No. 2,756,149, Reynolds et al. U.S. Pat. No. 2,768,078, Gray et al. U.S. Pat. No. 2,839,401, Minsk U.S. Pat. Nos. 2,882,156 and 2,945,006, Whitmore et al. U.S. Pat. No. 2,940,849, Condax U.S. Pat. No.2,952,566, Mader et al. U.S. pat. No. 3,016,305, Minsk et al. U.S. pat. Nos. 3,048,487 and 3,184,309, Bush U.S. Pat. No. 3,271,147, Whitmore U.S. Pat. No. 3,271,148, Jones et al. U.S. Pat. No. 3,282,699, Wolf et al. U.S. Pat. No. 3,408,193, Cohen et al. U.S. Pat. Nos. 3,488,706, 3,557,066, 3,625,694, 3,709,690, 3,758,445, 3,788,855, 3,898,088, and 3,944,424, Cohen U.S. Pat. No. 3,639,357, Taylor U.S. Pat. No. 3,770,439, Campbell et al U.S. Pat. No. 3,958,995, and Ponticello et al. *Research Disclosure,* Vol. 120, April 1974, Item 12045. Preferred mordants for forming filter layers are more specifically disclosed by *Research Disclosure,* Vol. 167, March 1978, Item 16725.

The disclosure of the patents and publications cited above, here incorporated by reference, provide a variety of examples of positive and negative-working dye image providing compounds which can be employed as subtractive dyes or dye precursors in the electrographic imaging compositions of this invention. The colorant portion of the preferred electrographic imaging compositions is additionally comprised of at least one immobile additive primary colorant or a combination of immobile colorants capable of collectively providing a desired additive primary color. Unlike the subtractive primary dyes and dye precursors, the immobile additive colorants which provide an additive primary color should remain immobile at all times and should not wander from the microcells either before, during, or after a photographic image is obtained. Suitable immobile colorants can be selected from among a variety of materials, such as dyes and pigments, but are most preferably pigments, since these can be more readily obtained in highly immobile forms. Useful immobile colorants can be selected from the *Color Index,* 2nd Edition, 1956, Vols. I and II. Useful immobile polymeric dyes are illustrated by Goldman et al U.S. Pat. No. 3,743,503. Specific preferred immobile pigments are disclosed in *Research Disclosure,* Vol. 109, May 1973, Item 10938, Paragraph IX-C-2, here incorporated by reference. Exemplary of preferred green, red, and blue immobile pigments are Monolite Green GN, Red Violet MR® (Hoechst), Pyrazalone Red® (Harmon), Alkali Blue MG® (Sherwin-Williams), and Monolite Blue® (ICI). Exemplary of useful green, red, and blue substantially immobile dyes are Renazol Brilliant Green 6B, Red Dye R3G (Drimarene Scarlet)® (Sandoz), and MX-G Procion Blue® (ICI). The proportions of the subtractive primary dye or dye precursor to the immobile additive primary colorant can be varied as desired to achieve an intended imaging result without the exercise of invention. The proportions will vary, depending upon the specific materials selected. For most materials ratios of subtractive primary dye or dye precursor to immobile additive colorant in the range of from about 1:10 to 10:1, most commonly 1:2 to 2:1, are operative, although optimum color balancing for a specific application requires individual adjustment by empirical procedures well known to those skilled in the art.

The resinous portion which together with the colorant portion forms dispersed particles in the liquid electrographic developer is preferably insoluble in the liquid carrier vehicle or only slightly soluble therein. Resinous materials acting as binders appear to form a coating around the colorants and thus facilitate dispersion in the liquid carrier. Examples of useful resins are: alkyd resins as described in Australian Pat. No. 254,001; acrylic resins described, for example, in U.S. Pat. Nos. 3,671,646 and 3,334,047; alkylated polymers described, for example, in U.S. Pat. Nos. 3,542,681 and '682; rosins described, for example in U.S. Pat. No. 3,399,140; polystyrene as described, for example in Australian Pat. No. 253,986 and U.S. Pat. No. 3,296,140; addition polymers containing a polar moiety as described, for example, in U.S. Pat. No. 3,788,995; ethyl cellulose described in U.S. Pat. No. 3,703,400; cellulosic polymers as described, for example, in U.S. Pat. No. 3,293,183; polyamides, shellac as described, for example, in U.S. Pat. No. 2,899,335; waxes or rubber-modified polystyrenes as described, for example, in U.S. Pat. No. 3,419,411; rosin-modified as described, for example, in U.S. Pat. No. 3,220,830; silica aerogels as described, for example, in U.S. Pat. No. 2,877,133; halogenated polyethylenes described, for example, in U.S. Pat. No. 2,891,911; graft copolymers described, for example, in U.S. Pat. No. 3,623,986; cyclized rubbers described, for example, in U.S. Pat. No. 3,640,863; vinyl polymers described, for example, in U.S. Pat. No. 3,585,140 as well as coumarone-indene resins; ester gum resins; and polymerized blends of certain soluble monomers, polar monomers and, if desired, insoluble monomers as described in Belgian Pat. No. 784,367.

In order to exhibit electrographic properties, the imaging composition must have an electrostatic charge when dispersed as particles in a liquid carrier. The colorants can themselves impart the desired electrostatic charge to the dispersed particles. The colorants are selected to exhibit a single polarity of charge to insure the lowest possible minimum densities. The electrostatic charge polarity of the dispersed particles can be enhanced or controlled by the selection of resinous binder materials and/or suitable charge control agents. Illustrative charge control agents are the polyoxyethylated alkyl surfactants such as polyoxyethylated alkylamine, polyoxyethylene palmitate, and polyoxyethylene stearate. Other useful materials are magnesium and heavier metal soaps of fatty and aromatic acids as described in U.S. Pat. Nos. 3,417,019, 3,032,432, 3,290,251, 3,554,946, 3,528,097, and 3,639,246. Useful metal soaps include cobalt naphthenate magnesium naphthenate and manganese naphthenate, zinc resinate, calcium naphthenate, zinc linoleate, aluminum resinate, isopropyltitanium stearate, aluminum stearate, and others many of which are also described in Matkan U.S. Pat. No. 3,259,581. Typically, the amount of such materials used is less than about 2 percent by weight based on the weight of the imaging composition. In certain instances, the resinous binder materials per se can function as the charge control agent as disclosed, for example, in U.S. Pat. No. 3,788,995, cited above. A dispersing aid can also be added as shown, for example in U.S. Pat. No. 3,135,695. This patent shows an electrographic liquid developer prepared by surrounding or dispersing electrographic-type pigment particles with a suitable resinous binder envelope and treating the pigment-binder combination with a small amount of an alkylaryl compound before suspending the combination in a liquid aliphatic carrier. This type of liquid electrographic developer is especially useful due to its relatively high stability. Other addenda may include: a phospholipid charge stabilizing material, e.g., lecithin, as described in U.S. Pat. Nos. 3,220,830, 3,301,677, 3,301,698, 3,241,957, 3,668,126, and 3,674,693, and U.K. Pat. No. 1,337,325; noble metal salts as described in French Pat. No. 1,354,520, isocyanate compounds as described in U.K. Pat. No. 654,977, and U.S. Pat. No. 3,383,316; magnetic particles as described in U.S. Pat. No. 3,155,531; conductive materials as described in U.S. Pat. Nos. 3,300,410 and 3,409,358; fatty acid esters as described in U.S. Pat. No. 3,692,520; manganese salts as described in U.S. Pat. No. 3,438,904; antistain agents as described in U.S. Pat. No. 3,681,243; and hydroxy-stearins as described in U.S. Pat. No. 3,701,731.

Conventionally, the liquid carrier vehicle used in liquid electrographic developers has a low dielectric constant less than about 3.0 and a resistivity of at least about $10^8$ ohm-cm, preferably at least $10^{10}$ ohm-cm. These requirements automatically eliminate water and most alcohols. However, a number of liquids still are available to satisfy the above-noted requirements and have been found to function as effective carrier vehicles for liquid developers. Among the various useful liquid carrier vehicles are alkylaryl materials such as the xylenes, benzenes, alkylated benzenes and other alkylated aromatic hydrocarbons such as are described in U.S. Pat. No. 2,899,335. Other useful liquid carrier vehicles are various hydrocarbons and halogenated hydrocarbons such as cyclohexane, cyclopentane, n-pentane, n-hexane, carbon tetrachloride, fluorinated lower alkanes, such as trichloromonofluorane and trichlorotrifluorethane, typically having a boiling range of from about 2° C. to about 55° C. Other useful hydrocarbon liquid carrier vehicles are the paraffinic hydrocarbons, for example, the isoparaffinic hydrocarbon liquids having a boiling point in the range of 145° C. to 185° C. (sold under the trademark Isopar by Exxon) as well as alkylated aromatic hydrocarbons having a boiling point in the range of from 157° to 177° C. (sold under the trademark Solvesso 100 by Exxon). Various other petroleum distillates and mixtures thereof may also be used as liquid carrier vehicles. Additional carrier liquids which may be useful in certain situations include polysiloxane oils such as dimethyl polysiloxane as described in U.S. Pat. Nos. 3,053,688 and 3,150,976; Freon carriers as described in Canadian Pat. No. 701,875 and U.S. Pat. No. 3,076,722; mixtures of polar and nonpolar solvents as described in U.S. Pat. No. 3,256,197; aqueous conductive carriers such as described in U.S. Pat. No. 3,486,922; non-flammable liquid carriers such as described in U.S. Pat. No. 3,058,914; polyhydric alcohols such as described in U.S. Pat. No. 3,578,593; and emulsified carriers such as described in U.S. Pat. Nos. 3,068,115 and 3,507,794. Electrographic imaging composition can be dispersed in the liquid carrier vehicle in any convenient conventional concentration, typically in the range of from 0.01 to 10 percent by weight based on total weight. Conventional techniques for dispersing the electrographic imaging composition can be employed, as disclosed, for example, in *Research Disclosure,* Item 10938, cited above, Paragraph IX-E and F.

One function of the microcells when provided in photographic elements is to limit lateral image spreading. The degree to which it is desirable to limit lateral image spreading will depend upon the photographic application. Where a photographic image is to be viewed without enlargement and minimal visible graininess is desired, microcells having widths within the range of from about 1 to 200 microns, preferably from about 4 to 100 microns, are contemplated for use in the practice of this invention. To the extent that visible graininess can be tolerated for specific photographic applications, the microcells can be still larger in width. Where the photographic images produced are intended for enlargement, microcell widths in the lower portion of the width ranges are preferred. It is accordingly preferred that the microcells be about 20 microns or less in width where enlargements are to be made of the images produced by microcellular imaging. Where the microcells of the support are intended to contain a radiation-sensitive material to perform an imaging function, the lower limit on the size of the microcells is a function of the photographic speed desired. As the areal extent of the microcells is decreased, the probability of an imaging amount of radiation striking a particular microcell on exposure is reduced. Microcell widths of at least about 7 microns, preferably at least 8 microns, optimally at least 10 microns, are contemplated where the microcells contain radiation-sensitive materials of camera speed. At widths below 7 microns, silver halide emulsions in the microcells can be expected to show significant reductions in speed.

The microcells can be of any necessary depth to contain the materials intended to be placed therein. It is generally preferred that the microcells be sized so that they are entirely filled, although in some forms of the invention partial filling of the microcells is contemplated. In terms of actual dimensions, the depth of the microcells is chosen as a function of the materials to be placed therein. For example, in photographic applications the depth of the microcells is chosen to permit the material contained therein to provide a desired optical density. The depths of the microcells can be less than, equal to, or greater than their width. For photographic applications the depth of the microcells is typically chosen to correspond to the thickness to which the same materials are conventionally coated on planar supports. It is generally contemplated that the depth of the microcells will fall within the range of from about 1 to 1000 microns. For the preferred electrographic imaging compositions, it is generally preferred that the microcells be in the range of from 5 to 20 microns in depth.

The spacing between microcells can be varied, depending upon the application and the effect intended. It is generally preferred for the practice of this invention that the microcells be laterally spaced from about 0.5 to 5 microns, although both greater and lesser spacings are contemplated. The microcells for photographic applications occupy at least 50 percent (preferably 80 percent) of the array area. The microcells can, when closely spaced, occupy as much as 99 percent of the array area, but more typically in the practice of this invention occupy no more than 90 percent of the array area.

Any conventional photoconductive material or combination of photoconductive materials can be employed in the microcellular supports of this invention. Suitable photoconductive materials are disclosed, for example, in *Research Disclosure,* Vol. 109, May 1973, Item 10938, Paragraph IV, here incorporated by reference. Photoconductive materials which in themselves are capable of forming microcells can be employed alone, as in the case of polymeric organic photoconductors which are plastically deformable. The photoconductive material is preferably incorporated in a separate insulative binder to form a microcellular structure, as disclosed by Wiegl, cited above, and here incorporated by reference. Preferred photoconductive supports and support portions can be formed as taught by Contois et al, *Research Disclosure,* Vol. 108, April 1979, Item 10823, here incorporated by reference. Other support portions, such as the conductive layers and base portions, can take any conventional form, exemplary materials being disclosed in *Research Disclosure,* Item 10938, cited above, Paragraphs II Suppprts and III Interlayers, here incorporated by reference.

In a specific preferred form at least the photoconductive portion of each support is substantially transparent. Where the photoconductive material forms a part of a multicolor reflective photographic print, for instance, even a slight coloration is apparent to the human eye and therefore objectionable. For such applications, preferred photoconductive materials are those sensitive to the ultraviolet portion of the spectrum, but not sensitized to the visible spectrum, to avoid imparting a visible minimum density. Such photoconductive materials can be addressed with an ultraviolet laser beam.

In certain applications, as where radiation-sensitive materials are intended to be located in the microcells, it is not practical to use ultraviolet radiation to address the photoconductive portion, since many radiation-sensitive imaging materials exhibit a native sensitivity in the ultraviolet region of the spectrum. For example, silver halide possesses a native sensitivity in the near portion of the ultraviolet spectrum. For introducing each of blue, green, and red-sensitized silver halide into separate sets of microcells, the photoconductive portion is preferably sensitized to the red or a longer wavelength region of the spectrum. The first and second sets of microcells can be addressed with a red laser beam without fogging the blue and green-sensitized silver halides inroduced into the first and second sets of microcells. Even if a third laser scan is employed, the red-sensitized silver halide introduced into the third set of microcells is not fogged, since the red-sensitized silver halide is not introduced until after the third laser scan is completed.

Sensitization of photoconductive materials to a selected portion of the spectrum can be undertaken employing spectral sensitizing dyes well known in the electro-graphic arts, such as those disclosed in *Research Disclosure,* Item 10838, cited above, Paragraph IV—C. Any minimum density imparted by spectral sensitization need not be objectionable. For example, if the photographic image to be produced is not intended to be viewed directly, such as a multicolor negative image used for printing a multicolor positive image, coloration due to spectral sensitization is not objectionable, since color correction can be introduced in printing by procedures well known to those skilled in the art.

In those instances in which an image-bearing photographic element according to this invention is a multicolor negative intended to be used in printing a multicolor positive image or a multicolor positive intended for projection viewing, it is preferred that the lateral walls between adjacent microcells exhibit an elevated optical density and, preferably, the lateral walls should be substantially opaque, but the bottom walls forming the microcells should remain substantially transparent. Where the microcells are intended to contain radiation-sensitive material, increasing the absorption of exposing readiation by the lateral walls can reduce halation and resulting loss of image definition. For each of these purposes the lateral walls are preferably of increased optical density, but the bottom walls forming the microcells preferably remain substantially transparent. This can be achieved by introducing a dye selectively into the lateral walls of the support. In general any dye which absorbs light over at least a portion of the visible spectrum and which does not unacceptably desensitize the photoconductive material can be employed. Preferred dyes for projection and printing applications are of neutral density. For antihalation purposes, the absorption of the dye at least extends over a spectral region within which the radiation-sensitive material exhibits an absorption peak. For example, dyes which absorb in at least the blue portion of the spectrum are useful with radiation-sensitive silver halides. Sudan Black B and Genacryl Orange are exemplary of useful intra-microcellular absorbing dyes.

A preferred technique for concurrently forming microcells in the support and selectively dyed lateral walls is as follows: A support identical to any of those described above, but lacking microcells, is employed as a starting element. Such supports can be fabricated by conventional techniques, which form no part of the present invention. One or a combination of dyes capable of imparting the desired optical density to the lateral walls to be formed are dissolved in a solution capable of softening the first major surface of the support, which at this stage is planar. The solution can be any conventional plasticizing solution for the photoconductive portion adjacent the first major surface. As the solution is spread over the first major surface, it migrates into the adjacent photoconductive portion of the support and carries with it dye, so that the photoconductive portion of is both dyed and softened adjacent the first major surface. Thereafter, the support can be embossed on its softened and therefore relatively deformable surface. This produces microcells in the support which have dyed lateral walls and transparent bottom walls, the transparent bottom walls result from the dyed and softened portions of the photoconductive portion being laterally displayed during embossing. A suitable embossing tool can be made by procedures which are within the skill of the art, such as those disclosed by Whitmore and Gilmour, copending and both cited above, and here incorporated by reference. If lateral walls of elevated density are not required, the procedure described above can be repeated, simply omitting the dye from the plasticizer solution or even omitting the plasticizer entirely. Other methods of forming microcells, lacking dyed lateral walls, are disclosed by Wiegl, cited above.

In photographic applications it has been recognized that the incorporation of imaging compositions in microcells has the effect of limiting lateral image spreading. Lateral image spreading has been observed in a wide variety of conventional photographic elements. Lateral image spread can be a product of optical phenomena, such as reflection or scattering of exposing radiation; diffusion phenomena, such as lateral diffusion of radiation-sensitive and/or imaging materials in the radiation-sensitive and/or imaging layers of the photographic elements; or, most commonly, a combination of both. Lateral image spreading is particularly common where the radiation-sensitive and/or other imaging materials are dispersed in a vehicle or binder intended to be penetrated by exposing radiation and/or processing fluids. While the present invention can be practiced with conventional radiation-sensitive and image-forming materials known to be useful in photography, it is appreciated that materials which exhibit visually detectable lateral image spreading are particularly benefited by incorporation into microcells according to this invention.

A variety of useful nonsilver radiation-senitive imaging materials useful in the practice of this invention are disclosed by Kosar, *Light-Sensitive Systems: Chemistry and Application of Nonsilver Halide Photographic Processes,* John Wiley and Sons, 1965. Generally any imaging system capable of forming a multicolor image can be applied to the practice of this invention. It is specifically preferred to employ in the practice of this invention, radiation-sensitive silver halide and the image forming materials associated therewith in multicolor imaging. Exemplary materials are described in *Research Disclosure,* Vol. 176, December 1978, Item 17643, the disclosure of which is here incorporated by reference. Particularly pertinent are paragraphs I. Emulsion types, III. Chemical sensitization, IV. Spectral sensitization, VI. Antifoggants and stabilizers, IX. Vehicles, and X. Hardeners, which set out conventional features commonly present in preferred silver halide emulsions useful in the practice of this invention.

It is specifically contemplated to incorporate the radiation-sensitive imaging materials in the colorant portion of electrographic imaging compositions as described above. The appropriate proportion of radiation-sensitive materials to subtractive primary dyes and dye precursors will be apparent from conventional photographic compositions, where mole ratios of silver halide to subtractive primary dye or dye precursor ranges from about 1 to 100:1. For example, radiation-sensitive silver halide is commonly employed in combination with dye-forming couplers in mole ratios of from about 2 to 100:1, more typically from about 3 to 60:1 however dye-forming couplers require at least two equivalents of silver to form one equivalent of image dye, whereas other subtractive primary dyes and dye precursors provide at least theoretically image dye in a 1:1 molar ratio with silver halide. Radiation-sensitive silver halide is typically formed in a peptizer, such as gelatin, and can be incorporated in the colorant portion as an emulsion, wherein the nonsilver or vehicle portion of the emulsion can be present in any conventional weight ratio, typically up to about 2:1.

The use of silver halide precipitating agents is disclosed in connection with various preferred forms of multicolor image transfer element 500. A wide variety of silver precipitating agents can be utilized. Such agents are incorporated into conventional photographic organic hydrophilic colloid layers such as gelatin and polyvinyl alcohol layers and include such physical nuclei or chemical precipitants as (a) heavy metals, especially in colloidal form and salts of these metals, (b) salts, the anions of which form silver salts less soluble than the silver halide of the photographic emulsion to be processed, and (c) nondiffusible polymeric materials with functional groups capable of combining with and insolubilizing silver ions.

Typical useful silver ion complex precipitating agents include sulfides, selenides, polysulfides, polyselenides, thiourea and its derivatives, mercaptans, stannous halides, silver, gold, platinum, palladium, mercury, colloidal silver, aminoguanidine sulfate, aminoguanidine carbonate, arsenous oxide, sodium stannite, substituted hydrazines, xanthates, and the like. Poly(vinyl mercaptoacetate) is an example of a suitable nondiffusing polymeric silver precipitate. Heavy metal sulfides such as lead, silver, zinc, aluminum, cadmium and bismuth sulfides are useful, particularly the sulfides of lead and zinc alone or in an admixture of complex salts of these with thioacetamide, dithio-oxamide or dithiobiuret. The heavy metals and the noble metals particularly in colloidal form are especially effective. Other silver precipitating agents will occur to those skilled in the present art.

Useful oxidized developing agent scavengers can include ballasted or otherwise nondiffusing (immobile) antioxidants, as illustrated by Weissberger et al. U.S. Pat. No. 2,336,327, Loria et al. U.S. Pat. No. 2,728,659, Vittum et al. U.S. Pat. No. 2,360,290, Jelley et al. U.S. Pat. No. 2,403,721, and Thirtle et al. U.S. Pat. No. 2,701,197. To avoid autooxidation the scavengers can be employed in combination with other antioxidants, as illustrated by Knechel et al. U.S. Pat. No. 3,700,453.

The invention can be more specifically appreciated by reference to the following illustrative examples:

EXAMPLE 1—Preparation of Green Pigment Concentrates

A. Nine grams of a finely divided immobile particulate green pigment, Monolite Green GN, were mixed with 4.5 grams of a copolymer of tert-butylstyrene and lithium methacrylate along with 85.5 grams of Solvesso 100®. The concentrate was ball-milled for two weeks at room temperature.

B. Eight grams of a finely divided immobile particulate green pigment, Monolite Green GN, were mixed with 8.0 grams of a copolymer of tert-butylstyrene, lauryl methacrylate, lithium methacrylate, and methacrylic acid in the weight ratio of 60:36:3.6:0.4 (hereinafter designated TBS) and 72.0 grams of Solvesso 100®. The concentrate was ball-milled for two weeks at room temperature.

EXAMPLE 2—Preparation of Red Pigment Concentrates

A. Four grams of a finely divided immobile particulate red pigment, Red Violet MR® (Hoechst), were mixed with 4.0 grams TBS and 36.0 grams of Solvesso 100®. The concentrate was ball-milled for two weeks at room temperature.

B. Nine grams of a finely divided immobile particulate red pigment, Pyrazolone Red® (Harmon), were mixed with 9.0 grams of TBS and 81.0 grams of Solvesso 100®. The concentrate was ball-milled for two weeks at room temperature.

EXAMPLE 3—Preparation of Blue Pigment Concentrates

A. Ten grams of a finely divided immobile particulate blue pigment, Monolite Blue® (ICI), were mixed with 14.0 grams of TBS and 126.0 grams of Solvesso 100®. The concentrate was ball-milled for two weeks at room temperature.

B. Five grams of a finely divided immobile particulate blue pigment, Alkali Blue MG® (Sherwin-Williams) were mixed with 5.0 grams of TBS and 45.0 grams of Solvesso 100®. The concentrates was ball-milled for two weeks at room temperature.

EXAMPLE 4—Preparation of Mobile Magenta Dye-Forming Coupler Concentrate

Four and one-half grams of a mobile magenta dye-forming coupler, 1-(2-benzothiazolyl)-3-amino-5-pyrazolone, were mixed with 4.5 grams of TBS and 40.5 grams of Solvesso 100®. The concentrate was ball-milled for two weeks at room temperature.

EXAMPLE 5—Preparation of Mobile Cyan Dye-Forming Coupler Concentrate

The procedure of Example 4 was repeated, except a mobile cyan dye-forming coupler, 2,6-dibromo-1,5-naphthalendiol, was substituted for the magenta dye-forming coupler.

EXAMPLE 6—Preparation of Mobile Yellow Dye-Forming Coupler Concentrate

A mobile yellow dye-forming coupler, α-(4-carboxyphenoxy)-α-pivalyl-2,4-dicloroacetanilide, in the amount of 3.14 grams was mixed with 3.14 grams of TBS and 28.3 grams of Solvesso 100®. The concentrate was ball-milled for two weeks at room temperature.

EXAMPLE 7—Preparation of Green Pigment and Magenta Dye-forming Coupler Containing Electrographic Imaging Composition Dispersed in Carrier Vehicle to Form Electrographic Developer A green pigment concentrate of Example 1 and the magenta dye-forming coupler concentrate of Example 4 were mixed in equal weights of 3.85 grams each with 4.55 grams of a 10 percent by weight solution of a copolymer of ethyl acrylate, ethyl methacrylate, lauryl methacrylate, and lithium sulfoethyl methylacrylate in Solvesso 100®. To this mixture was added Isopar G® at the rate of 6 ml per minute for the first 50 ml and then at the rate of 15 ml per minute until the volume of the developer reached 500 ml. This addition was performed under ultrasonic shear.

EXAMPLE 8—Preparation of Red Pigment and Cyan Dye-forming Coupler Containing Electrographic Imaging Composition Dispersed in Carrier Vehicle to Form Electrographic Developer The procedure of Example 7 was repeated, except a red pigment concentrate of Example 2 was substituted for the green pigment concentrate of Example 1 and the cyan dye-forming coupler concentrate of Example 5 was substituted for the magenta dye-forming coupler concentrate of Example 4.

EXAMPLE 9—Preparation of Blue Pigment and Yellow Dye-forming Coupler Containing Electrographic Imaging Composition Dispersed in Carrier Vehicle to Form Electrographic Developer The procedure of Example 7 was repeated, except a blue pigment concentrate of Example 3 was substituted for the green pigment concentrate of Example 1 and the yellow dye-forming coupler concentrate of Example 6 was substituted for the magenta dye-forming coupler concentrate of Example 4.

EXAMPLE 10—Preparation of Photoconductive Microcellular Support

A conventional planar photoconductive element consisting of a transparent 102 micron thick poly(ethylene terephthalate) film base coated with a transparent 0.2 micron cuprous iodide electrically conductive layer which was in turn overcoated with a 2 micron cellulose nitrate charge control barrier layer, and an 8 micron organic photoconductive layer, was employed as a starting material. The photoconductive element is similar to a commercially available recording film sold under the trademark Kodak Ektavolt SO-101. The recording film and its characteristics are generally described in *A Mini-Textbook—KODAK Products for Electrophotography,* Kodak Publication No. G-95, Standard Book Number 0-87985-233-X, Eastman Kodak Company, 1979. The conductive layer and film base extend laterally beyond the photoconductive layer along one edge to allow convenient electrical contact with the conductive layer.

An array of hexagonal projections 20 microns in width and approximately 7 microns high was formed on a copper plate by etching in generally the same manner described in the Whitmore patent application cited above. An embossing solvent was placed on the plate between one edge of the array of projections and a strip of pressure-senstive tape employed to restrain migration of the solvent away from the projections. A sheet of the recording film was placed on the plate with the photoconductive layer adjacent the projections, and the resulting sandwich was advanced beneath a roller with the edge bearing the embossing solvent passing beneath the roller first. The pressure exerted by the roller and the softening action of the embossing solvent being spread laterally at the roller nip resulted in a hexagonal array of microcells being formed on the photoconductive layer having lateral bottom walls corresponding to the walls of the hexagonal projections. The embossing solvent was a roughly equal volume mixture of methanol and dichloromethane containing 0.51 parts by volume per 100 parts of solvent Sudan Black B (Color Index No. 26150). As a result, the lateral walls of the microcells were dyed black, since the dye entered the photoconductive layer along with the embossing solvent. The bottom walls of the microcells remained substantially transparent, however.

EXAMPLE 11—Introduction of Imaging Compositions into Microcells of Support

The embossed photoconductive portion of the support was given a charge of +460 volts by being passed through a corona discharge. The conductive electrode was attached to ground. Except as stated the support was not intentionally exposed to light to which the photoconductive portion was responsive. The positively charged support was scanned with a laser having wavelength of 482 nm. In one area of the support every third row of microcells was scanned. In another area all of the microcells were scanned. For selected row scanning an indexing laser was employed in combination with the scanning laser. The indexing laser beam was laterally displaced from that of the scanning laser so as to be located outside the imaging area. The indexing laser was of a red wavelength to which the photoconductive portion was less responsive. The indexing laser was employed in combination with a photosensor to detect the position of the lateral walls of the microcells. Thus, three interruptions of the indexing laser beam detected by the photosensor in advancing the support provided a positive indication that the support had been advanced three rows of microcells. The dyed lateral walls of the microcells facilitated indexing as well as obviating light scatter to adjacent microcells.

After the laser scan was completed the microcellular support was electrographically developed using the electrographic developer of Example 7 using a development time of 10 seconds. A development electrode biased to +200 volts was employed.

The procedure was twice repeated using the electrographic developers of Examples 8 and 9. Under microscopic examination interlaid rows of microcells containing the electrographic imaging compositions of Examples 7, 8, and 9 were observed. In three separate areas all of the microcells were filled with one of the three electrographic imaging compositions.

EXAMPLE 12—Formation of Screened Multicolor Positive Using Color Image Transfer Photographic Element The element produced by Example 11 was employed to form a multicolor screened positive using additive primary pigments and a transferred multicolor negative using subtractive primary dyes formed by the mobile couplers.

The filled microcells were overcoated with a mixed silver sulfide and silver iodide silver precipitating agent dispersed in 2 percent by weight gelatin using a 50 micron coating doctor blade spacing. A commercially available black-and-white photographic paper having a panchromatically sensitized gelatino-silver chlorobromide emulsion layer was attached along an edge to the microcellular support with the emulsion layer of the photographic paper facing the microcell containing surface of the support. The photographic paper was imagewise exposed through the support (and therefore through the filters formed by the pigments in the microcells) with the elements in face-to-face contact. After exposure, the elements were separated, but not detached, and immersed for 3 seconds in the color developer of Table I.

TABLE I

| Color Developer | | |
|---|---|---|
| Benzyl alcohol | 12 | ml |
| Sodium sulfite, desiccated | 2.5 | gm |
| 4-Amino-3-methyl-N,N-diethylaniline monohydrochloride | 2.5 | gm |
| Sodium hydroxide | 5.0 | gm |
| Sodium thiosulfate | 10.0 | gm |
| 6-Nitrobenzimidazole nitrate | 20 | mg |
| Water to 1 liter | | |

Thereafter, the elements were restored to face-to-face contact for 1 minute to permit development of the imagewise exposed silver halide and image transfer to occur. The elements were then separated, and the silver image was bleached from the photographic paper. A three-color negative image was formed by subtractive primary dyes in the photographic paper while a three-color screened positive image was formed by the additive primary filters and the transferred silver image on the microcellular support.

EXAMPLE 13—Formation of Transferred Multicolor Positive

Example 12 was repeated, but with a silver halide emulsion layer coated over the filled microcells and the silver nucleating agent layer being coated on a separate planar film support. The emulsion layer was a high-speed panchromatically sensitized gelatino-silver halide emulsion layer coated with a 150-micron coating doctor blade spacing. The color developer was of the composition set fort in Table II.

TABLE II

| Color Developer | | |
|---|---|---|
| Benzyl alcohol | 12 | ml |
| Sodium sulfite, desiccated | 2.5 | gm |
| 4-Amino-3-methyl-N,N-diethylaniline monohydrochloride | 2.5 | gm |
| Sodium hydroxide | 7.5 | gm |
| Sodium thiosulfate | 60.0 | gm |
| 6-Nitrobenzimidazole nitrate | 20 | mg |
| Potassium bromide | 2.0 | gm |
| 1-Phenyl-3-pyrazolidone | 0.2 | gm |
| Water to 1 liter | | |

Both elements were immersed in the color developer for 5 seconds and thereafter held in face-to-face contact for 2 minutes. A screened three-color negative was obtained on the microcellular support and a transferred positive silver and multicolor positive dye image was obtained on the planar support.

EXAMPLE 14—Use of Immobile Additive Primary Dye

Three grams of an immobile red dye, Drimarene Scarlet ® (Sandoz), were mixed with 3.0 grams of TBS and 27.0 grams of Solvesso 100 ® to form a red dye containing concentrate. The concentrate was ball-milled for two weeks at room temperature. When the red dye concentrate of this example was substituted for the red pigment concentrate of Exaple 2 generally similar results were obtained, but the red pigment was found under microscopic examination to be somewhat more immobile.

EXAMPLE 15—Green Imaging Particles Produced By Immobile Yellow and Cyan Dyes

Twenty grams of 1-(2,4,6-trichlorophenyl)-3-[3-(2,4-diamylphenoxyacetamido)benzamido]-4-(p-methoxyphenylazo)-5-pyrazolone, a yellow-colored ballasted coupler,here employed as a substantially immobile yellow dye, and 40 grams of

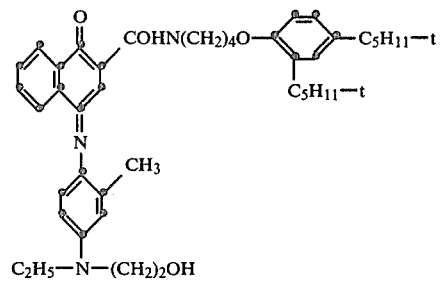

a substantially immobile cya, dye were melted and diluted to a volume of 750 ml with water to form an aqueous concentrate. To this concentrate were aded 3.0 grams of 1-(2,4,6-trichlorphenyl)-3-(4-nitroanilino)-5-pyrazolone, a mobile magenta dye-forming coupler. The magenta dye-forming coupler was dissolved in methanol and 5 percent by weight sodium hydroxide.

The resulting concentrate was formed into a particulate dispersion by forming a mist using a DeVilbus (Model 65) ® ultrasonic nebulizer. The mist was passed through an air drying column, and the neubulized solids were collected.

EXAMPLE 16—Red Imaging Particles Produced by Immobile Yellow and Magenta Dyes

The procedure of Example 15 was repeated, except that 30 grams of

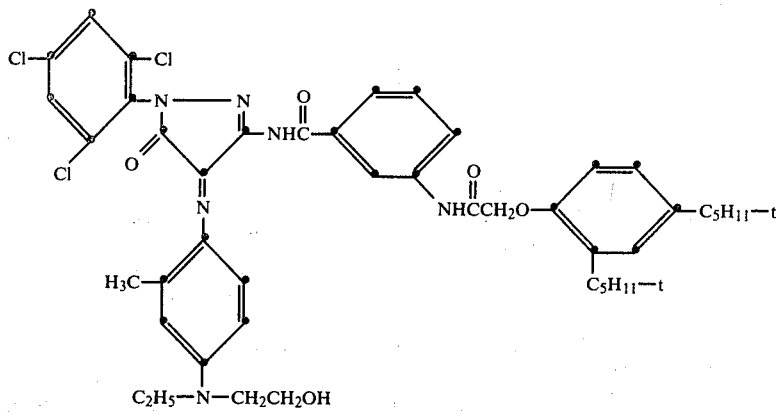

a substantially immobile ballasted magenta dye, was substituted for the substantially immobile cyan dye and the mobile cyan coupler, 1-hydroxy-2-[β-(2'-aceatamido)- phenethyl]naphthamide, was substituted for the mobile magenta coupler.

EXAMPLE 17 — Blue Imaging Particles Produced by Immobile Cyan and Magenta Dyes

The procedure of Example 16 was repeated, except that 30 grams of the substantially immobile cyan dye of Example 15 was substituted for the substantially immobile yellow dye and a mobile yellow dye-forming coupler, α-(4-carboxyphenoxy)-α-pivalyl-2,4-dichloroacetanilide, was substituted for the mobile cyan coupler.

EXAMPLE 18 — Preparation of Green Electrographic Imaging Composition Containing Immobile Subtractive Primary Dyes Dispersed in Carrier Vehicle to Form Electrographic Developer and Use Thereof The green imaging particles of Example 15 in the amount of 0.7 gram were mixed with 7.0 grams of a 10 percent by weight solution of TBS in Solvesso 100®. These materials were placed in a container and tumbled for 24 hours to form a concentrate. The resulting concentrate was mixed in the amount of 3.40 grams with 450 ml of Isopar G TM ultrasonic agitation.

The resulting electrographic imaging composition was then employed substantially as described in Example 11, except that only a single imaging composition was employed.

EXAMPLE 19 — Preparation of Red Electrographic Imaging Composition Containing Immobile Subtractive Primary Dyes Dispersed in Carrier Vehicle to Form Electrographic Developer and Use Thereof One gram of the red particles of Example 16 were mixed with 10 grams of a 10 percent by weight solution of TBS in Isopar G. These materials were mixed on a roller mill for 24 hours to form a concentrate. The resulting concentrate was mixed in the amount of 0.5 grams with 450 ml of Isopar G using ultrasonic agitation. The electrographic imaging composition particles in the resulting electrographic developer were about 5 microns in diameter.

The electrographic developer was employed substantially as described in Example 11, except that only a single imaging composition was employed.

EXAMPLE 20 — Preparation of Blue Electrographic Imaging Composition Containing Immobile Subtractive Primary Dyes Dispersed in Carrier Vehicle to Form Electrographic Developer and Use Thereof The procedure of Example 19 was repeated, but with the particles of Example 17 substituted for those of Example 16. Instead of using ultrasonic agitation to form the electrographic developer, a paint shaker was employed for agitation. The electrographic imaging composition particles were plate-like having a maximum dimension of from 10 to 15 microns. The resulting electrographic imaging composition was then employed substantially as described in Example 11, except that only the imaging composition of this example was employed.

In comparing the electrographic imaging compositions of Examples 18 through 20 with those of Examples 7 through 9, the former exhibited longer shelf life. That is, the electrographic imaging composition particles settled at a slower rate. The former also exhibited a higher charge to weight ratio and a higher extinction coefficient. The higher extinction coefficient resulted in a higher maximum optical density. It is attributed to a higher proportion of colorant, since materials such as coupler solvent and gelatin were entirely eliminated in using pigment colorants. Coupler mobility was intially observed to be higher using the compositions of Examples 18 through 20, but the mobility of couplers in pigment containing compositions was found to be susceptible to increase by empirically selecting mobile couplers to be employed.

The invention has been described in detail with particular reference to preferred embodiments thereof, but it will be understood that variations and modifications can be effected within the spirit and scope of the invention.

What is claimed is

1. In a process comprising forming in a support having first and second major surfaces a planar array of microcells opening toward the first major surface and selectively introducing a first imaging composition into a first set of microcells, and a second, differing imaging composition into a second set of microcells forming an interlaid pattern with the first set of microcells, the improvement comprising establishing an electrostatic charge pattern on the support differentiating the first and second sets of microcells and selectively introducing an electrographic first imaging composition into the first set of microcells.

2. The improved process according to claim 1, wherein the electrographic first imaging composition contains a substantially immobile additive primary colorant portion.

3. The improved process according to claim 2, wherein the colorant portion additionally contains a subtractive primary dye or dye precursor capable of shifting between a mobile and an immobile form as a function of silver halide development.

4. A process comprising applying an electrostatic charge in a nonimagewise manner to a photoconductive portion of a support means, the support means having first and second major surfaces and the photoconductive portion defining microcells opening toward the first major surface to form a planar array, selectively altering the electrostatic charge associated with a first set of microcells in relation to remaining, interlaid microcells, selectively introducing an electrographic imaging composition into the first set of microcells, and introducing a second imaging composition into at least a portion of the remaining microcells.

5. A process according to claim 4 in which the first set of microcells is addressed with a laser to selectively alter the electrostatic charge associated therewith.

6. A process according to claim 5 in which an electrostatic charge is applied in a nonimagewise manner after introducing the electrographic imaging composition, a second set of microcells is addressed with a laser to selectively alter the electrostatic charge associated therewith, and a second electrographic imaging composition is introduced into the second set of microcells.

7. A process comprising applying an electrostatic charge in a nonimagewise manner to a photoconductive portion of a support means, the support means having first and second major surfaces and the photoconductive portion defining microcells opening toward the first major surface to form a planar array, addressing a first set of microcells with radiant energy to which the photoconductive portion is responsive to selectively remove electrostatic charge, selectively introducing a first electrographic imaging composition into the first set of microcells, reapplying an electrostatic charge in a nonimagewise manner to the photoconductive portion of the support means, addressing a second set of microcells and at least a portion of the first set of microcells with radiant energy to which the photoconductive portion is responsive to selectively remove electrostatic charge, the second set of microcells forming an interlaid pattern with the first set of microcells, and introducing a second electrographic imaging composition into the second set of microcells while excluding the second electrographic imaging composition from the first set of microcells.

8. In a process comprising forming in a support having first and second major surfaces a planar array of microcells opening toward the first major surface and selectively introducing (1) a first imaging composition comprised of a substantially immobile first additive primary colorant means and a complementary subtractive primary dye or dye precursor into a first set of microcells, (2) a second imaging composition comprised of a substantially immobile second additive primary colorant means and a complementary subtractive primary dye or dye precursor into a second, interlaid set of microcells, and (3) a third imaging composition comprised of a substantially immobile third additive primary colorant means and a complementary subtractive primary dye or dye precursor into a third, interlaid set of microcells the improvement comprising establishing an electrostatic charge pattern on the support differentiating the first and remaining sets of microcells.

selectively introducing an electrographic first imaging composition into the first set of microcells, differentiating the second and third sets of microcells in the electrostatic charge associated therewith, selectively introducing an electrographic second imaging composition into the second set of microcells, and introducing the third imaging composition into the third set of microcells.

9. The improved process according to claim 8, wherein the electrographic imaging compositions are introduced into the microcells in a liquid carrier vehicle having a dielectric constant of less than 3.0 and a resistivity of at least $10^{10}$ ohm-cm.

10. The improved process according to claim 9, wherein the electrographic imaging compositions are dispersed in a particulate form wherein the particles are less than half the width of the microcells.

11. In an element comprising support means having first and second major surfaces defining microcells opening toward said first major surface to form a planar array, two or more differing imaging compositions each located in a separate interlaid set of microcells, the improvement comprising said support including a photoconductive portion defining the microcells and at least one of said imaging compositions being electrographic.

12. An element comprising support means having first and second major surfaces including a photoconductive portion defining microcells opening toward said first major surface to form a planar array, the microcells being separated by lateral walls and having bottom walls formed by the photoconductive portion, three differing imaging compositions each located in a separate interlaid set of microcells, and at least two of the imaging compositions being electroscopic.

13. An element according to claim 12, in which the microcells are less than 200 microns in width.

14. An element according to claim 12, in which the lateral walls are capable of absorbing light and the bottom walls are substantially transparent.

15. An element according to claim 12, in which said support means includes a conductive layer portion.

16. An element according to claim 12, in which the microcells are hexagonal.

17. An element according to claim 12, in which microcells of at least one set are separated by laterally interposed microcells of remaining sets.

18. An element according to claim 12, in which said imaging compositions are each comprised of a substantially immobile additive primary colorant means.

19. An element according to claim 18, in which said additive primary colorant means are each comprised of an immobile pigment.

20. An element according to claim 18, in which said imaging compositions each additionally include a subtractive primary dye or dye precursor capable of shifting between a mobile and an immobile form as a function of silver halide development.

21. An element according to claim 12, in which at least one radiation-sensitive imaging means is positioned adjacent said first major surface of said support means.

22. A photographic element comprising support means having first and second major surfaces including a photoconductive portion defining microcells opening toward said first major surface to form a planar array, said support means providing a lateral barrier between adjacent microcells, a segmented blue filter means located in a first set of the microcells, a segmented green filter means located in a second set of the microcells, a segmented red filter means located in a third set of the microcells, the first, second, and third sets of the microcells forming an interlaid pattern of blue, green, and red filter segments, and radiation-sensitive imaging means positioned adjacent said first major surface of said support means.

23. A photographic element according to claim 22, in which said radiation-sensitive imaging means is comprised of silver halide.

24. A photographic element according to claim 23, in which the microcells are from 7 to 20 microns in width.

25. A photographic element according to claim 22, in which a yellow dye or dye precursor is located in the first set of microcells, a magenta dye or dye precursor is located in the second set of microcells, and a cyan dye or dye precursor is located in the third set of microcells.

26. A photographic element according to claim 22, in which said radiation-sensitive imaging means is a panchromatically sensitized silver halide emulsion.

27. A photographic element according to claim 22, in which the first set of microcells contains blue-sensitive silver halide, the second set of microcells contains green-sensitized silver halide, and the third set of microcells contains red-sensitized silver halide.

28. A photographic element according to claim 22, in which said lateral barrier between adjacent microcells is capable of absorbing radiation to which said radiation-sensitive imaging means is responsive.

29. A photographic element comprising support means having first and second major surfaces including a photoconductive portion defining microcells opening toward said first major surface to form a planar array, said support means being impermeable to aqueous alkaline processing solution and forming transparent bottom walls of the microcells and light absorbing lateral walls providing a barrier between adjacent microcells, an immobile blue filter and a yellow dye or dye precursor capable of shifting between a mobile and an immobile form as a function of silver halide development located in a first set of the microcells, an immobile green filter and a magenta dye or dye precursor capable of shifting between a mobile and an immobile form as a function of silver halide development located in a second set of the microcells, an immobile red filter and a cyan dye or dye precursor capable of shifting between a mobile and an immobile form located in a third set of the microcells, the first, second, and third sets of microcells forming an interlaid pattern, a transparent cover sheet overlying said first major surface of said support means, radiation-sensitive silver halide located between said support means and said transparent cover sheet, a dye immobilizing means located adjacent said cover sheet, reflective pigment means for providing a reflective surface underlying said dye immobilizing means, an aqueous alkaline processing solution, and means for initially confining and thereafter releasing said aqueous alkaline processing solution at a location between said support means and said cover sheet.

30. A photographic element according to claim 29, in which said aqueous alkaline processing solution contains a silver halide solvent, and silver reception means including means for precipitating silver solubilized in the aqueous alkaline processing solution is positioned between said reflective pigment means and said support means.

31. An electrographic imaging composition comprising a colorant portion comprised of one or more immobile colorants collectively capable of producing an additive primary color and a complementary subtractive primary dye or dye precursor capable of shifting between a mobile and an immobile form as a function of silver halide development, from 0.1 to 10 parts by weight per part of the colorant portion of a resinous portion capable of forming a particulate dispersion with the colorant portion in a liquid carrier vehicle having a dielectric constant of less than 3.0 and a resistivity of at least $10^{10}$ ohm-cm, and at least one of said colorant and resinous portions being chosen to impart an electrostatic charge of a selected polarity to the particulate dispersion in the liquid carrier.

32. An electrographic imaging composition according to claim 31 in which at least one of the immobile colorants is an immobile pigment.

33. An electrographic imaging composition according to claim 31 in which the additive primary color is provided by a combination of subtractive primary colorants.

34. An electrographic imaging composition according to claim 31 in which said resinous portion is present in from 0.3 to 3.0 parts by weight per part of the colorant portion.

35. An electrographic imaging composition according to claim 31 in which said resinous portion contains a charge control agent in an amount sufficient to impart an electrostatic charge of a selected polarity to the particulate dispersion in the liquid carrier.

36. An electrographic imaging composition comprising a colorant portion comprised of one or more immobile pigments collectively capable of imparting a blue color to the composition and a yellow dye or dye precursor capable of shifting between a mobile and an immobile form as a function of silver halide development, and from 0.3 to 3.0 parts by weight per part of the colorant of a resinous portion capable of forming a particulate dispersion with the colorant portion in a liquid hydrocarbon having dielectric constant of less than 3.0 and a resistivity of at least $10^{10}$ ohm-cm, the binder portion including a charge control agent in an amount sufficient to impart an electrostatic charge of a positive polarity to the particulate dispersion in the liquid hydrocarbon.

37. An electrographic imaging composition comprising a colorant portion comprised of one or more immobile pigments collectively capable of imparting a green color to the composition and a magenta dye or dye precursor capable of shifting between a mobile and an immobile form as function of silver halide development, from 0.3 to 3.0 parts by weight per part of the colorant of a resinous portion capable of forming a particulate dispersion with the colorant portion in a liquid hydrocarbon having a dielectric constant of less than 3.0 and a resistivity of at least $10^{10}$ ohm-cm, the resinous portion including a charge control agent in an amount sufficient to impart an electrostatic charge of a positive polarity to the particulate dispersion in the liquid hydrocarbon.

38. An electrographic imaging composition comprising a colorant portion comprised of one or more immobile pigments collectively capable of imparting a red color to the composition and a yellow dye or dye precursor capable of shifting between a mobile and an immobile form as a function of silver halide development, from 0.3 to 3.0 parts by weight per part of the colorant of a resinous portion capable of forming a particulate dispersion with the colorant portion in a liquid hydrocarbon having a dielectric constant of less than 3.0 and a resistivity of at least $10^{10}$ ohm-cm, the resinous portion including a charge control agent in an amount sufficient to impart an electrostatic charge of a positive polarity to the particulate dispersion in the liquid hydrocarbon.

39. An electrographic developer comprising a liquid carier vehicle having a dielectric constant of less than 3.0 and a resistivity of at least $10^{10}$ ohm-cm and a particulate dispersion of an electrographic imaging composition according to claim 31.

40. An electrographic developer comprising a liquid hydrocarbon having a dielectric constant of less than 3.0 and a resistivity of at least $10^{10}$ ohm-cm and a particulate dispersion of an electrographic imaging composition according to claim 36, 37, or 38.

* * * * *